US012708858B2

(12) United States Patent
Maiden

(10) Patent No.: US 12,708,858 B2
(45) Date of Patent: Aug. 18, 2026

(54) DOLL TOY WITH ATTACHED CLOTHING AND HIDDEN POCKETS

(71) Applicant: Convertible Turtle, LLC, Thornton, CO (US)

(72) Inventor: Helen C. Maiden, Thornton, CO (US)

(73) Assignee: Convertible Turtle, LLC

( * ) Notice: Subject to any disclaimer, the term of this patent is extended or adjusted under 35 U.S.C. 154(b) by 329 days.

(21) Appl. No.: 18/477,263

(22) Filed: Sep. 28, 2023

(65) Prior Publication Data

US 2024/0181361 A1 Jun. 6, 2024

Related U.S. Application Data

(60) Provisional application No. 63/377,394, filed on Sep. 28, 2022.

(51) Int. Cl.
*A63H 3/00* (2006.01)
*A63H 3/02* (2006.01)
*A63H 3/52* (2022.01)

(52) U.S. Cl.
CPC ..... *A63H 3/005* (2013.01); *A63H 3/02* (2013.01); *A63H 3/52* (2013.01)

(58) Field of Classification Search
CPC . A63H 3/005; A63H 3/02; A63H 3/16; A63H 3/36; A63H 3/52; A63H 33/004
USPC ..... 446/73, 98, 99, 268, 369
See application file for complete search history.

(56) References Cited

U.S. PATENT DOCUMENTS 2,093,207 A * 9/1937 Munson, Jr. ..... A63H 3/52 283/81
3,051,959 A * 9/1962 Baws ..... A63H 3/52 2/65
3,939,604 A * 2/1976 Nishizawa ..... A63H 3/00 428/6
4,138,744 A * 2/1979 Pitzel ..... A41D 15/04 2/195.7
4,336,665 A * 6/1982 Moreau ..... A63H 3/12 446/369
4,543,669 A * 10/1985 Katz ..... A63H 3/02 2/84
4,563,159 A * 1/1986 Hills ..... A63H 3/005 446/369
4,590,633 A * 5/1986 Pickens ..... A63H 3/005 5/413 R
4,639,233 A * 1/1987 Brassfield ..... A63H 3/12 446/99

(Continued)

FOREIGN PATENT DOCUMENTS

GB 2335374 A * 9/1999 ..... A63H 3/14

OTHER PUBLICATIONS

U.S. Appl. No. 29/881,412, filed Dec. 30, 2022, Maiden.
U.S. Appl. No. 29/894,356, filed Jun. 8, 2023, Maiden.

*Primary Examiner* — Alexander R Niconovich
(74) *Attorney, Agent, or Firm* — Polsinelli PC

(57) ABSTRACT

A doll or doll toy includes more than one outfits or costumes which can be sewn or otherwise attached to an internal cavity or pocket contained within the doll toy. A particular costume can be extended to the outside of the doll toy and worn by the doll toy, while the remaining costume or costumes are retained or stored within the body of the doll toy itself. In one aspect one or more reversible hats corresponding to the costumes can also be included and stored within the body of the doll toy itself.

19 Claims, 28 Drawing Sheets

(56) References Cited

U.S. PATENT DOCUMENTS 4,739,529 A * 4/1988 Mills ..... A47G 9/083 446/72
4,842,565 A * 6/1989 VonPhilp, Sr. ..... A63H 3/02 446/369
5,046,986 A * 9/1991 Wood ..... A63H 3/12 446/268
5,090,938 A * 2/1992 Reynolds ..... G09B 19/0061 434/137
5,194,034 A * 3/1993 Heppenstall ..... A63H 3/52 446/268
5,328,399 A * 7/1994 Reynolds ..... A63H 33/004 2/209.12
5,328,400 A * 7/1994 Bass ..... A63H 3/50 446/268
5,746,639 A * 5/1998 Bloom ..... A63H 3/52 446/369
5,791,963 A * 8/1998 Lieberman ..... A42B 1/206 446/72
6,120,340 A * 9/2000 Zaborowski ..... A63H 3/44 446/73
6,126,507 A * 10/2000 Lieberman ..... A63H 3/003 446/72
6,261,149 B1 * 7/2001 Moore ..... A63H 33/004 446/369
6,343,968 B1 * 2/2002 Louie ..... A47G 9/083 5/413 R
6,434,769 B1 * 8/2002 Koenig ..... A47G 9/0261 5/639
6,676,478 B1 * 1/2004 Starner ..... A63F 9/02 446/73
6,719,606 B1 * 4/2004 Mukensturm ..... A63H 3/005 446/72
6,755,712 B2 * 6/2004 Morris ..... A63H 3/005 446/268
6,902,462 B2 * 6/2005 Treibitz ..... A63H 3/02 446/369
8,506,344 B2 * 8/2013 Chan ..... A63H 3/52 446/268
8,550,866 B2 * 10/2013 Wadhwani ..... A63H 3/003 446/72
9,649,570 B2 * 5/2017 Karsten ..... A63H 3/02
9,724,615 B2 * 8/2017 Chan ..... A63H 3/28
10,179,673 B2 * 1/2019 Garcia ..... B65D 75/28
10,201,762 B2 * 2/2019 Sutton ..... A63H 3/12
10,786,746 B2 * 9/2020 Badie ..... A63H 3/365
10,940,398 B2 * 3/2021 Smelcer ..... A63H 3/365
11,173,411 B2 * 11/2021 Badie ..... A63H 3/365
11,235,253 B2 * 2/2022 Towne ..... A63H 3/36
11,338,215 B2 5/2022 Badie
12,330,081 B2 * 6/2025 Webb ..... A63H 3/36
2001/0046830 A1 11/2001 Bellavia
2007/0161324 A1 * 7/2007 Garrett ..... A63H 3/46 446/369
2007/0232186 A1 * 10/2007 Shamah ..... A63H 3/005 446/369
2010/0178837 A1 * 7/2010 Daniels ..... A63H 3/02 446/73
2012/0088428 A1 * 4/2012 Smoot ..... A63H 3/005 446/73
2013/0052912 A1 * 2/2013 Pampliega ..... A63H 3/16 446/376
2014/0227933 A1 * 8/2014 Bagla ..... A63H 3/02 446/73
2014/0287648 A1 * 9/2014 Rebella ..... A63H 33/004 446/73
2014/0287649 A1 * 9/2014 Rebella ..... A63H 33/004 446/73
2015/0111459 A1 * 4/2015 Anderman ..... A63H 33/00 29/428
2015/0314205 A1 * 11/2015 Rebella ..... A63H 33/004 446/73
2020/0238185 A1 * 7/2020 Towne ..... A63H 3/36
2022/0105437 A1 * 4/2022 Towne ..... A63H 3/52

* cited by examiner

FIG. 23
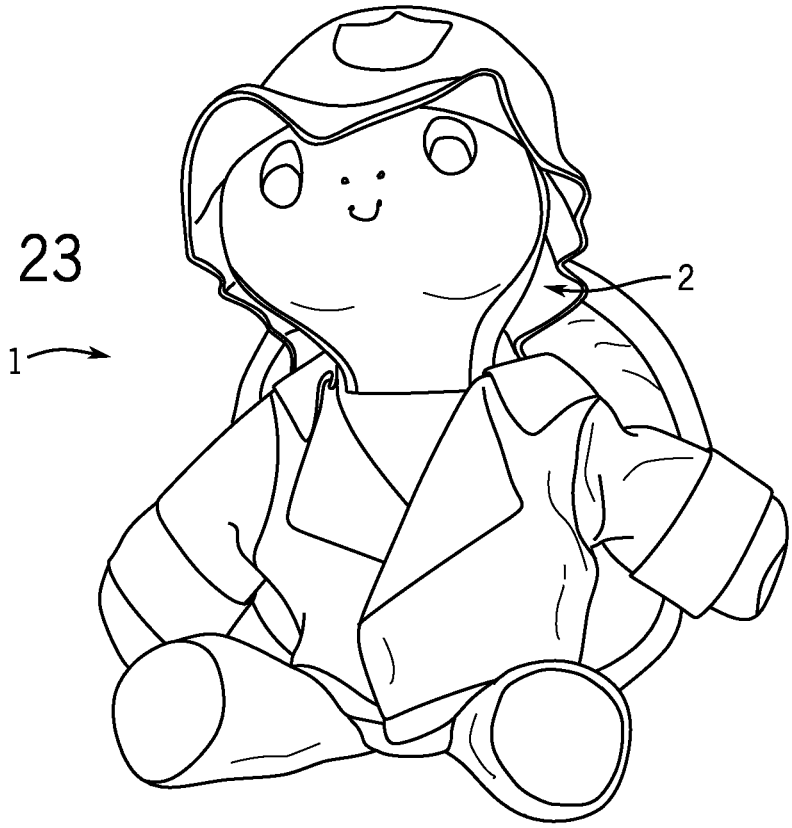
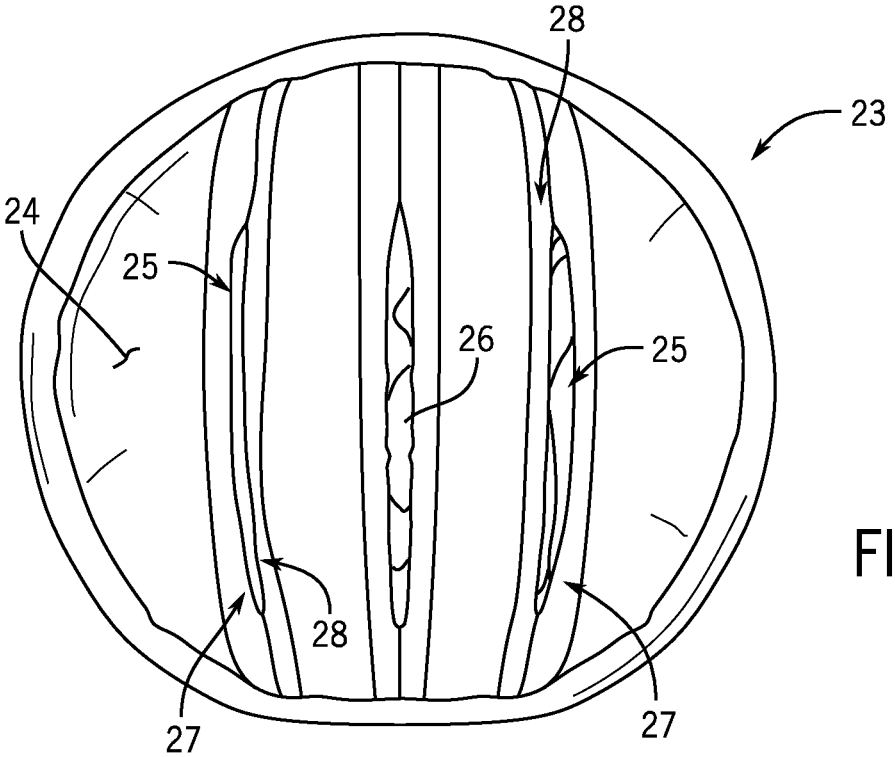
FIG. 24

DOLL TOY WITH ATTACHED CLOTHING AND HIDDEN POCKETS

CROSS-REFERENCE TO RELATED APPLICATIONS

This application claims the benefit of U.S. Provisional Application No. 63/377,394, filed Sep. 28, 2022, which is incorporated by reference in its entirety herein and for all purposes.

FIELD OF THE INVENTION

The present invention generally relates to a doll or doll toy having multiple outfits or costumes which are sewn or otherwise attached to pockets contained within the doll toy itself.

BACKGROUND

Children enjoy playing with toys, such as dolls. There is a need in the art for doll toys that are convenient, interesting and engaging for children to play with and use.

SUMMARY

Briefly described, one embodiment of the present disclosure includes a doll or doll toy depicting an animal figure, such as turtle having a removable shell defining an interior cavity or pocket. One or more outfits or costumes can be attached to the edges of openings formed through the exterior layer of the shell portion that provide access to the interior cavity or pocket, or to interior surfaces adjacent thereto. During play, one costume can be extended through openings in the shell portion to the outside of the shell portion and worn by the doll toy, while any remaining costumes can remain stored within the shell portion.

In another embodiment, the doll toy can depict a different type of animal figure that does not include the removable shell (e.g., a rabbit, mouse, cow bear, elephant, a human, etc.) with the interior cavity or pocket being defined by or located within the body figure of the doll toy and opening to the back of the doll toy. One or more outfits or costumes can be attached to the interior edges of one or more openings of the pocket, or to interior surfaces adjacent thereto. During play, one costume can be extended from the pocket and worn by the doll toy, while any remaining costumes can be stored within the pocket.

Embodiments of the present disclosure can also include a reversible hat or hats corresponding to the costumes of the doll toy, and which can be stored separately within the shell portion or body figure of the doll toy and without attachment to the openings.

The costumes presented in this disclosure represent only a few of the possible costumes and are not intended to be limiting. A wide variety of costumes are contemplated, including but not limited to those representing different occupations and professions, branches of the military, sports uniforms, mythological or folk figures, and fantasy figures, among others.

BRIEF DESCRIPTION OF THE DRAWINGS

FIG. 23 is a perspective view of the doll toy of FIG. 21 in the second alternative costume.

FIG. 24 is a front view of the shell portion of the doll toy of FIG. 1 having three openings and with three costumes retained within the interior cavity or pocket of the shell portion, in accordance with another embodiment of the present disclosure.

DETAILED DESCRIPTION

Figure 1:
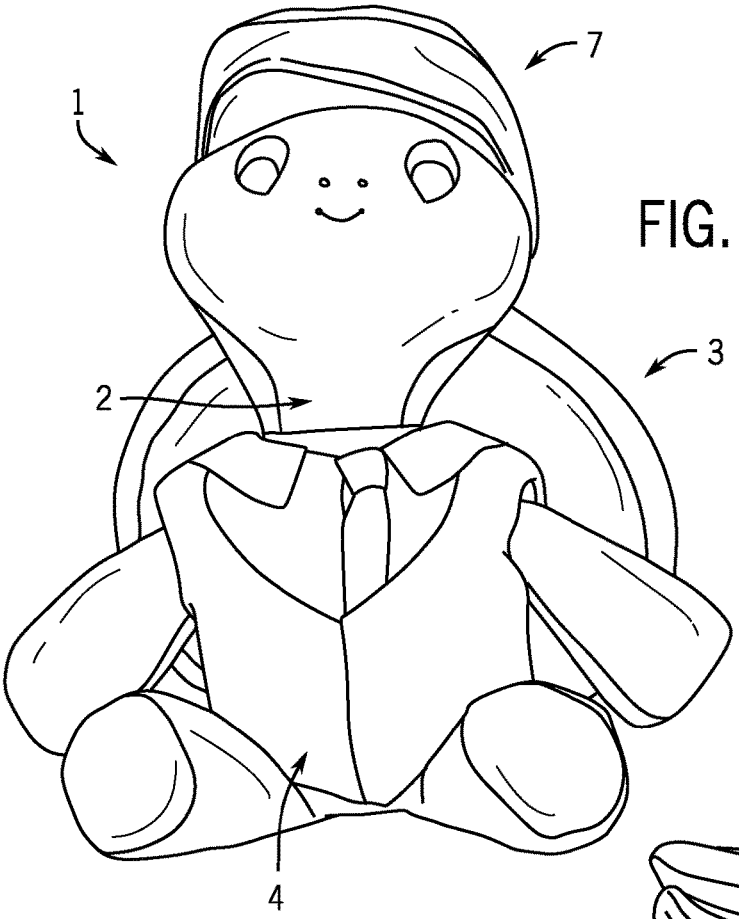
FIG. 1 is a front view of the doll toy dressed in a first costume, in accordance with one representative embodiment of the present disclosure in which the body of the doll toy includes a doll figure portion representative of a turtle together with a removable shell portion.
Figure 2:
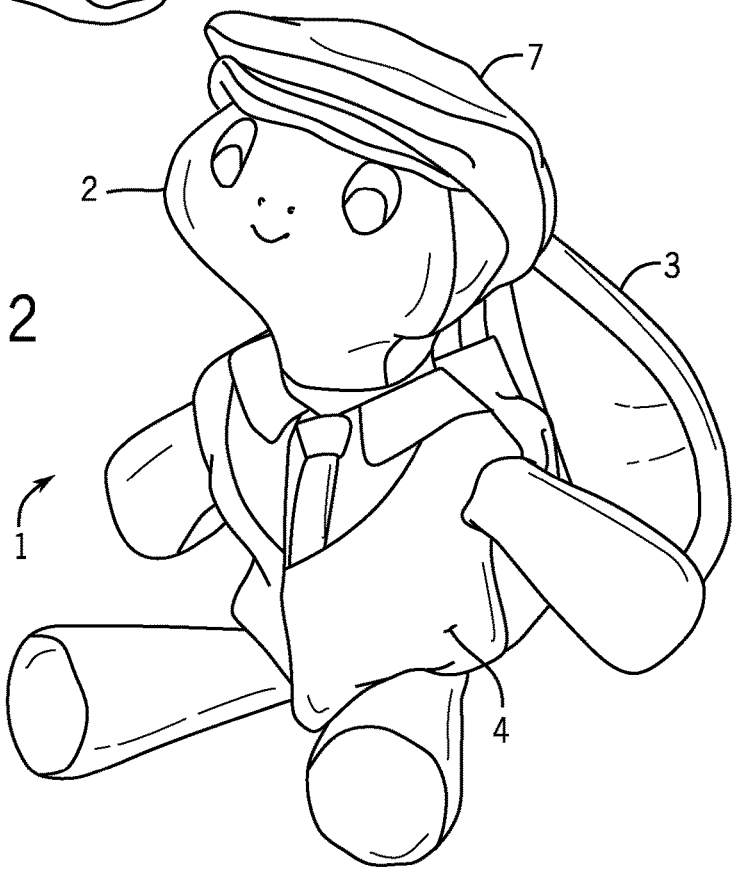
FIG. 2 is a perspective view of the doll toy of FIG. 1 dressed in the first costume.
Figure 3:
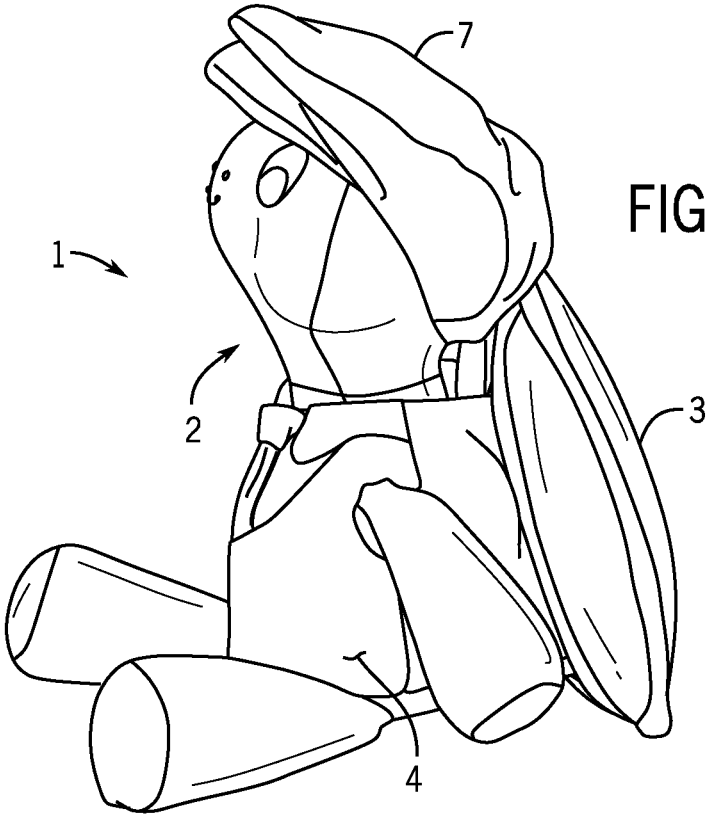
FIG. 3 is a side view of the doll toy of FIG. 1 dressed in the first costume.
Figure 4:
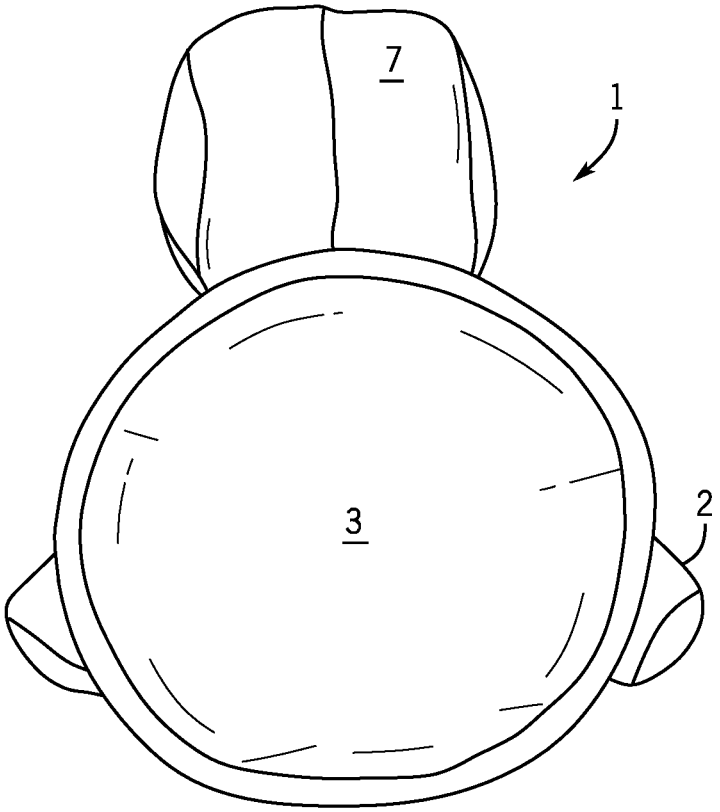
FIG. 4 is a back view of the doll toy of FIG. 1 dressed in the first costume.

The present disclosure relates to a toy or doll, such as a soft doll made from flexible fabric materials, having multiple outfits or costumes attached to openings in the doll toy and stored within one or more interior cavities or pockets.

In some embodiments, the doll toy can depict a primary figure, such as a turtle, with the costumes stored within a secondary container, such as a removable turtle shell.

In some embodiments the doll toy can depict a primary figure, such as a rabbit, a mouse, a cow, a bear, an elephant or any other animal figure, a human figure, a mythological or folk figure, a sports figure, a fantasy figure, and the like, with the costumes being stored within an interior cavity or pocket contained in the body figure portion, or primary figure, of the doll toy and opening to the back of the doll toy.

Turning to the figures, illustrative embodiments of the present disclosure will now be discussed in more detail.

FIGS. 1-4 are views of the soft doll or doll toy 1 in a first costume 4, in accordance with one representative embodiment of the present disclosure, in which the body of the doll toy 1 includes a doll figure portion 2 representative of a turtle, together with a removable shell portion 3 that houses one or more costumes. A first costume 4 can be wrapped around the doll figure portion 2 and secured with a closure or fastener, such as snaps, buttons, a hook and loop-type closure (e.g. a Velcro® closure), a zipper, or any other type of fabric closure or fastener known in the art. In one aspect the first costume 4 can further comprise an opposing pair of fabric panels, with each fabric panel having a first edge portion secured within an internal cavity or pocket, as described above, and a second panel portion extending outward through an opening in the pocket to wrap around a cover the doll figure portion 2 of the doll toy 1.

In one aspect the doll figure portion 2, or primary figure, can be a soft bodied doll representative of a turtle, made from fabric or other flexible material, and filled with Polyfil® fiber or other stuffing material. Likewise, the removable shell portion 3, or a secondary container, can be a removable, soft bodied container representative of a turtle shell. As described in more detail below, the shell portion 3 can include one or more costumes 4, 5 that are securable to or wearable by the doll figure portion 2, and one or more reversible hats 7 corresponding to the costumes, which can be stored or contained within the shell portion 3.

Figure 5:
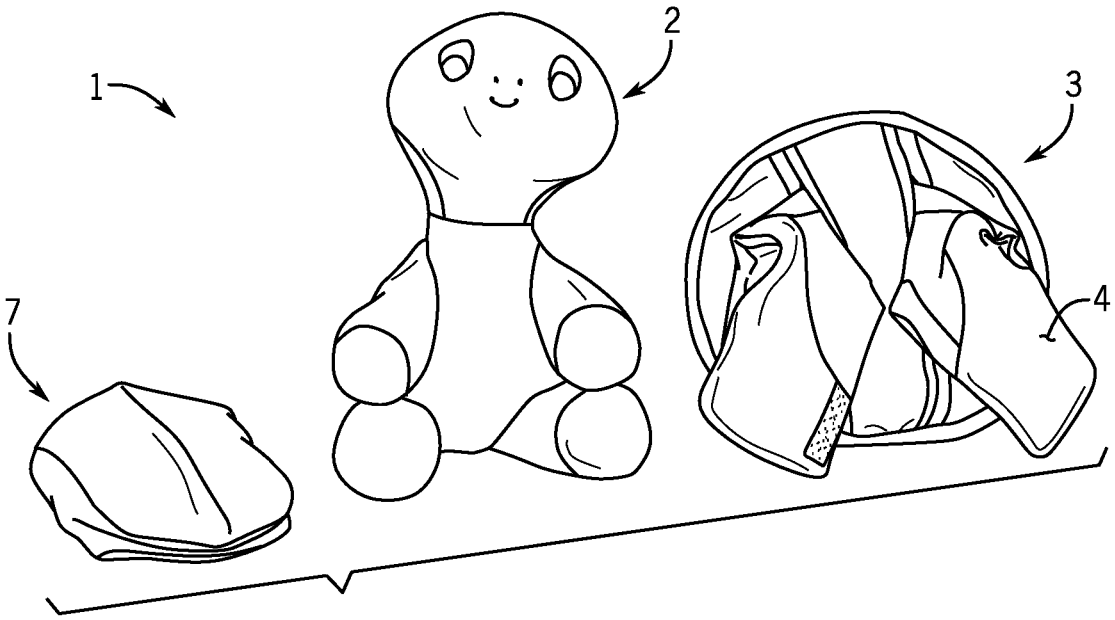
FIG. 5 is a front view of the doll toy of FIG. 1 showing the hat and the shell portion (with the first costume) removed from the doll figure portion.

FIG. 5 shows the doll figure portion 2 of the turtle version or embodiment of the doll toy 1 with the hat 7 and the shell portion 3 (with the extended first costume 4) being removed from the doll figure portion 2. In one aspect the first costume 4 and the shell portion 3 can be removed from the doll figure portion 2 of the doll toy 1 (e.g., by unfastening the hook and loop-type fastener of the first costume).

Figure 6:
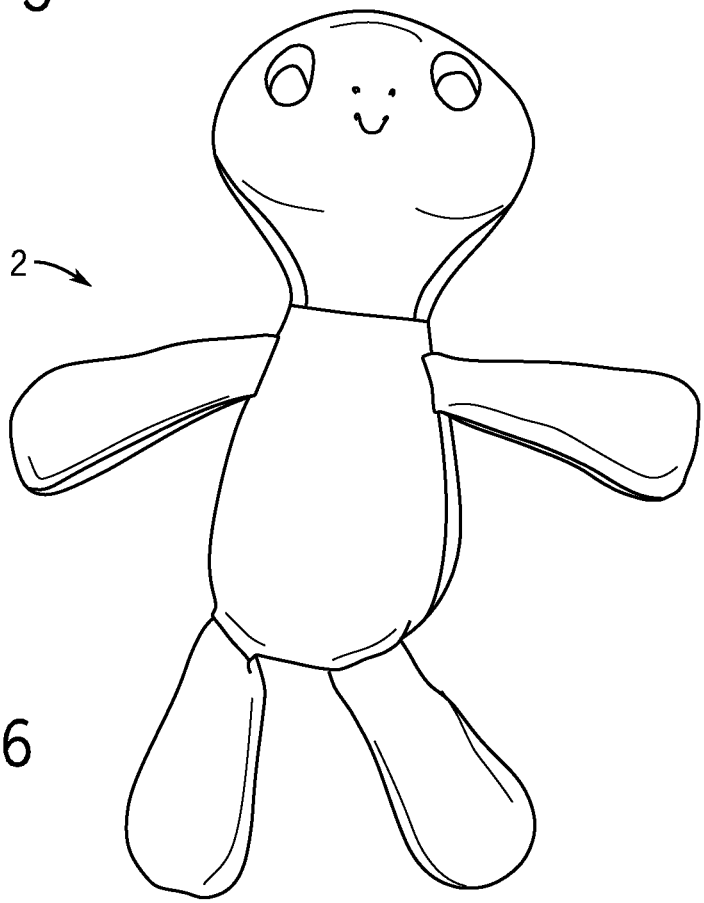
FIG. 6 is a front view of the doll figure portion of the doll toy of FIG. 1.
Figure 7:
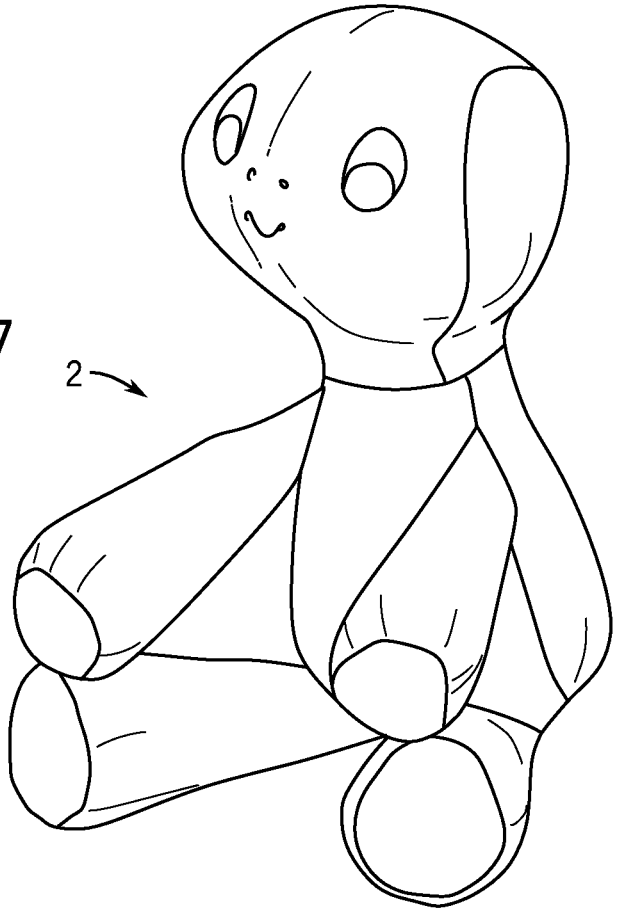
FIG. 7 is a perspective view of the doll figure portion of the doll toy of FIG. 1 in a seated position.
Figure 8:
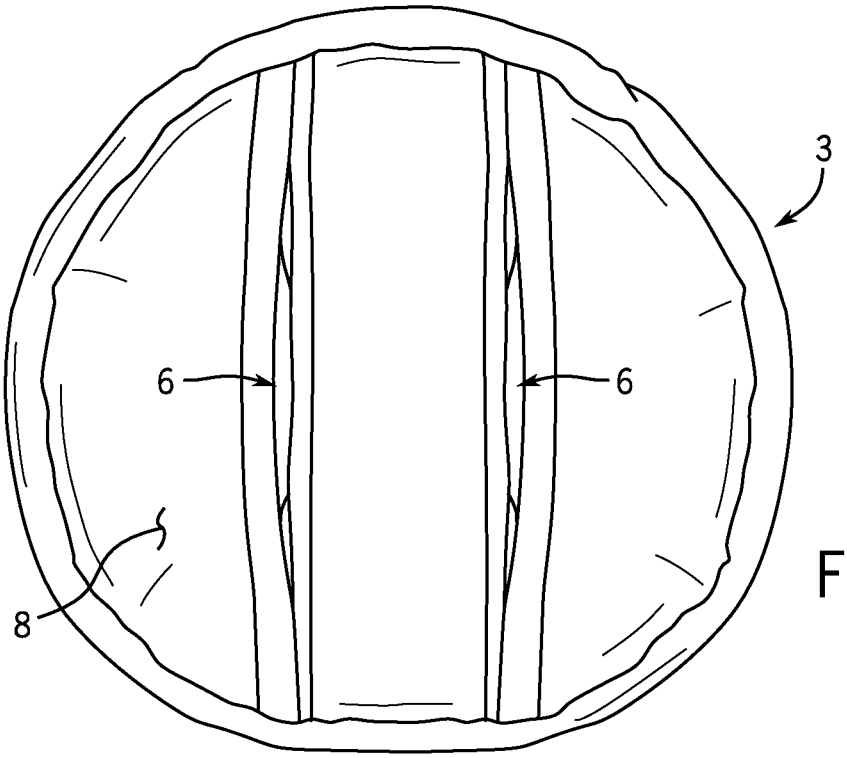
FIG. 8 is a front view of the shell portion of the doll toy of FIG. 1 having two openings formed through a front panel, and with two separate costumes being retained within an interior cavity or pocket of the shell portion.

FIGS. 6 and 7 provided different views of the doll figure portion 2 of the turtle embodiment of the doll toy 1 in isolation, while FIG. 8 is a front view of the shell portion 3 in isolation showing the two openings 6 in the front panel 8, and with two costumes (not shown) retained within the cavity or pocket of the shell portion 3.

FIGS. 5, 9-10, and 15-16 are views of the turtle embodiment of the doll toy 1 in transition from the first costume 4 to the second costume 5, as described below. For example, as shown in FIG. 5, the first costume 4 and the shell portion 3 can first be removed from the doll figure portion 2 of the doll toy 1.

Figure 9:
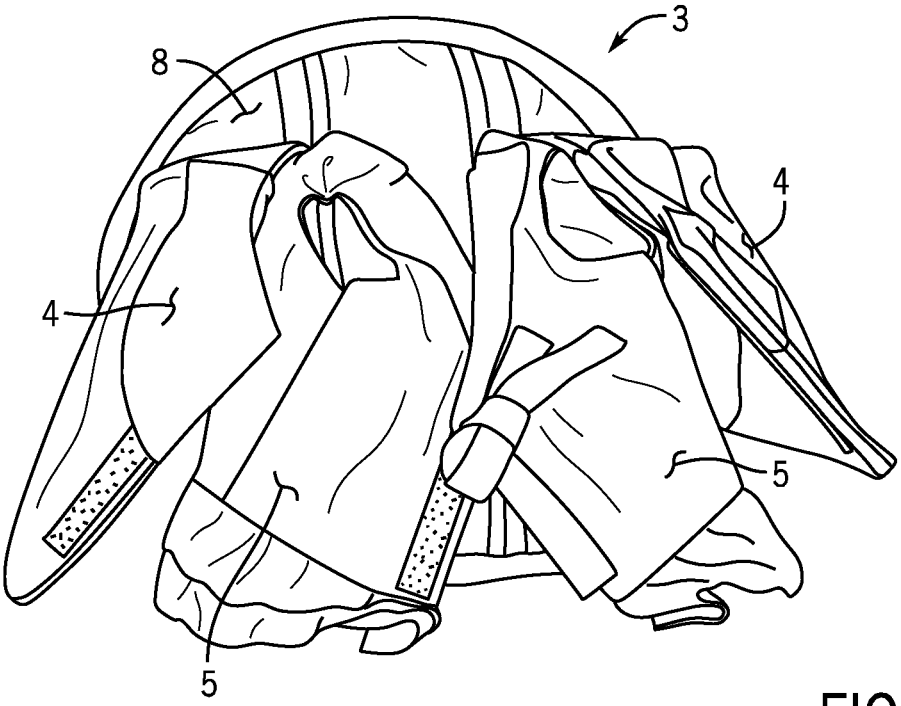
FIG. 9 is a front view of the shell portion of the doll toy of FIG. 1 with both the first and second costumes extending from the pockets to the outside of the shell portion.

As shown in FIG. 9 (which shows the shell portion 3 of the doll toy 1 with both the first costume 4 and the second costume 5 extending from the front panel 8 of the shell portion 3), the second costume 5 can also be withdrawn from the shell portion 3 through the openings 6 in the front panel 8 to which it is attached, which in one aspect can be the same openings 6 as the openings for the first costume 4. It will be appreciated that other configurations, such as separate openings for each of the first and second costumes, or even separate openings for each section of the first and second costumes, are also contemplated and considered to fall within the scope of the present disclosure.

Figure 10:
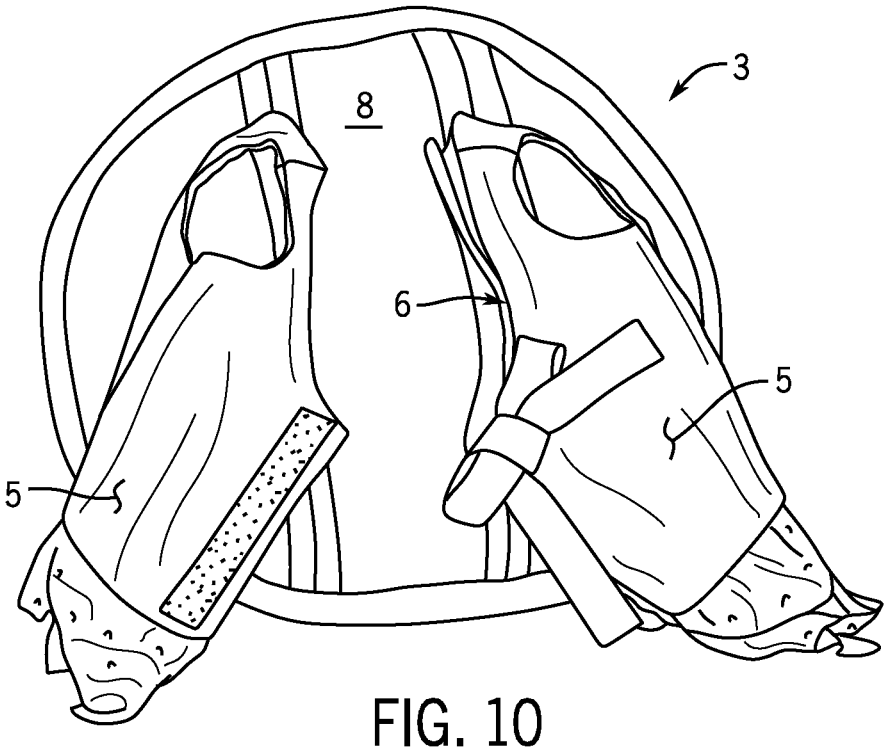
FIG. 10 is a front view of the shell portion of the doll toy of FIG. 1 with the second costume extending from the pocket to the outside of the shell portion and the first costume being retained within the interior cavity or pocket of the shell portion.

As shown in FIG. 10 (which shows the shell portion 3 of the doll toy 1 with the second costume 5 extending from the front panel 8 of the shell portion 3), the first costume 4 can be folded or rolled and placed inside the shell portion 3 through the openings 6 in the shell portion 3 to which it is attached in order to be retained within the interior pocket of the shell portion 3.

Figure 15:
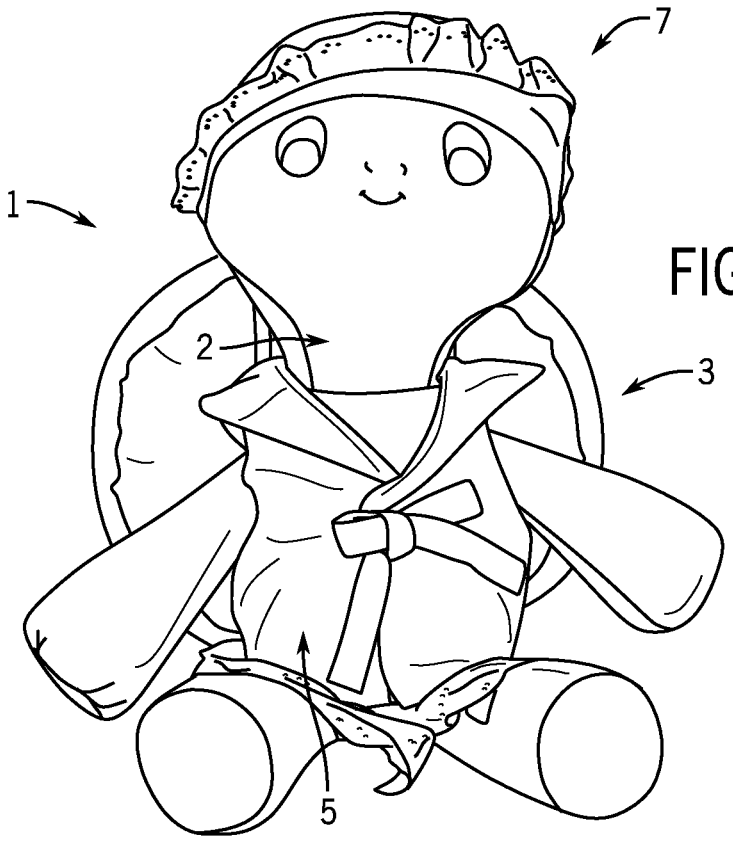
FIG. 15 is a front view of view of the doll toy of FIG. 1 dressed in the second costume.
Figure 16:
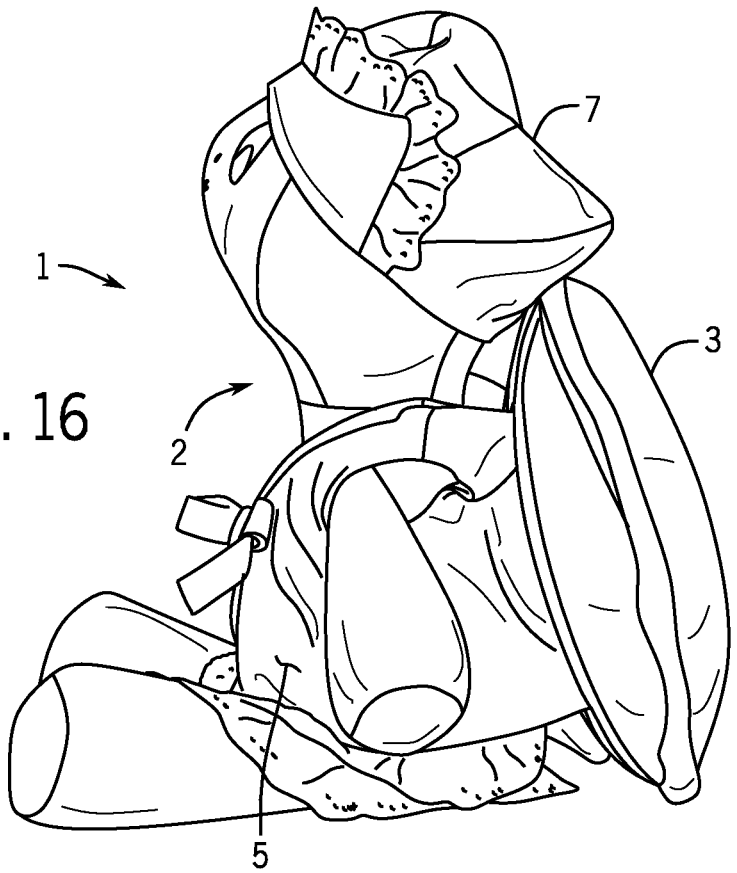
FIG. 16 is a side view of the doll toy of FIG. 1 dressed in the second costume.

With reference to FIGS. 15-16, the second costume 5 can then be placed on the doll figure portion 2 of the doll toy 1 and secured with the fastener (e.g., the hook and loop-type fastener), thus securing the second costume 5 and the shell portion 3 to the doll figure portion 2 of the doll toy 1. As shown in the figures, the reversible hat 7 that was originally configured to correspond with the first costume may also be re-configured to correspond with the second costume and also placed on the head of the doll toy.

Figure 11:
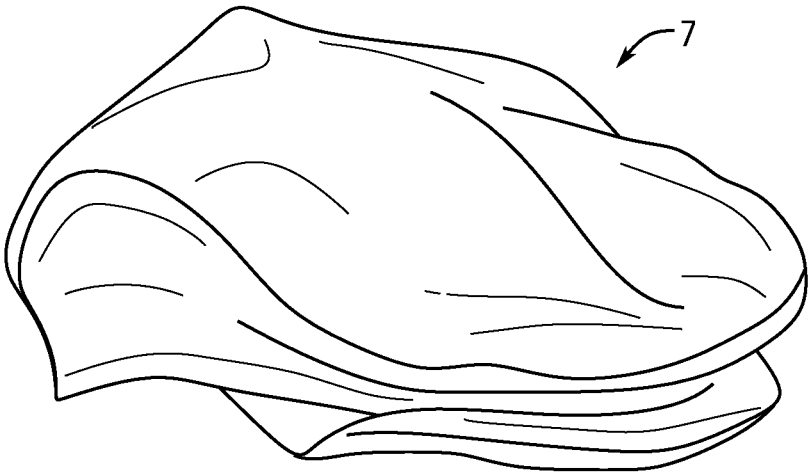
FIG. 11 is a perspective view of a reversible hat in a first configuration showing a first pattern or arrangement corresponding to the first costume of the doll toy of FIG. 1.
Figure 12:
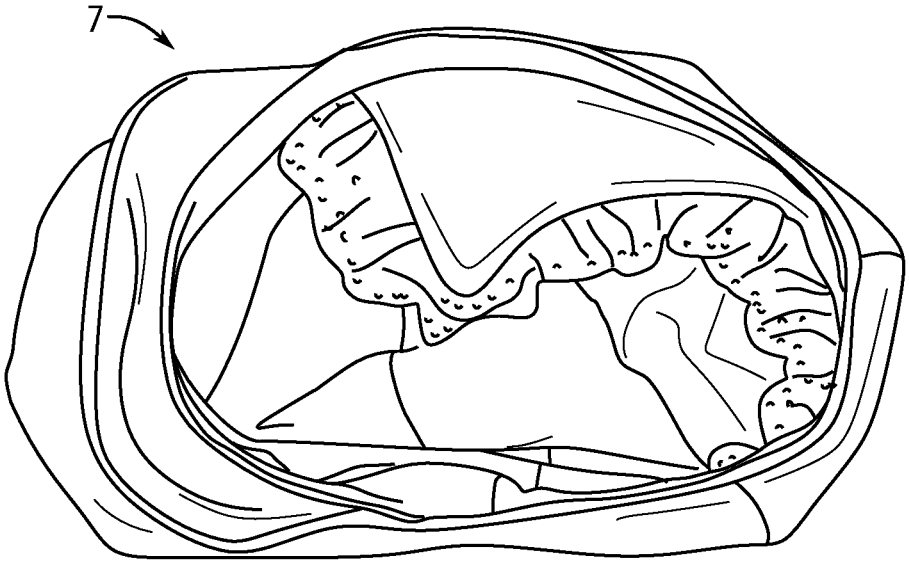
FIG. 12 is a bottom view of the reversible hat of FIG. 11, with the second pattern or arrangement of the reversible hat corresponding to the second costume of the doll toy being visible within the reversible hat.
Figure 13:
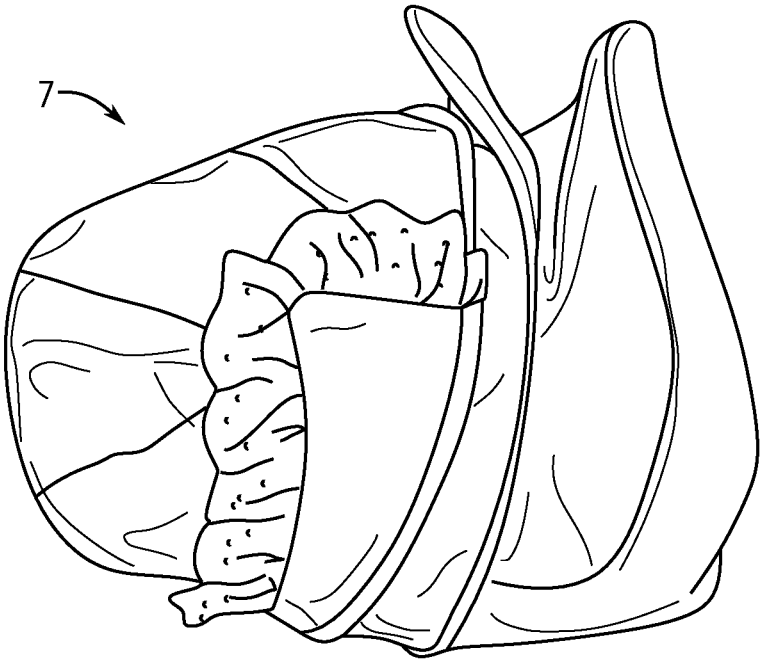
FIG. 13 is a side view of the reversible hat of FIG. 11 in a partial inside-out configuration, with the patterns for both the first and second costumes being visible.
Figure 14:
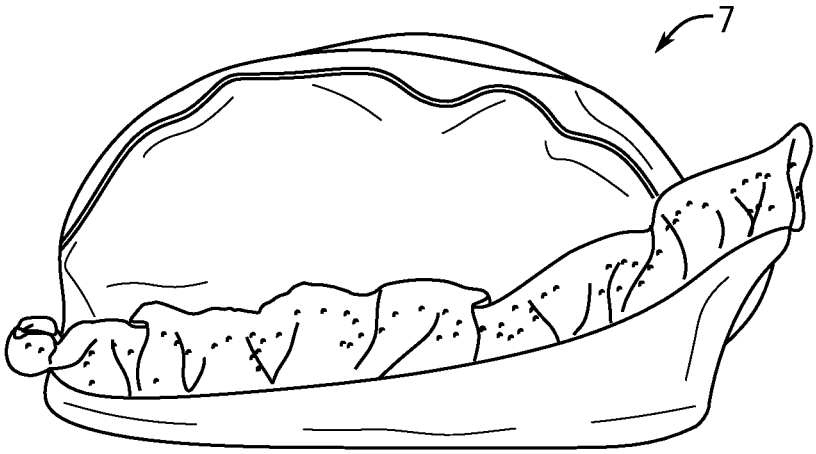
FIG. 14 is a front view of the reversible hat of FIG. 11 in a second configuration showing the second pattern corresponding to the second costume of the doll toy of FIG. 1.

For example, and with reference back to FIGS. 11-14, illustrated therein are progressive views of the reversible hat corresponding to the reconfiguration from the first costume to the second costume. FIG. 11 is a perspective view of the reversible hat in a first configuration showing a first pattern or arrangement corresponding to the first costume of the doll toy of FIG. 1. FIG. 12 is a bottom view of the reversible hat in a first configuration with the second pattern or arrangement of the reversible hat corresponding to the second costume of the doll toy being visible within the reversible hat. FIG. 13 is a side view of the reversible hat in a partial inside-out configuration, with the hats corresponding to the first and second costumes extended from each other and which are sewn or otherwise connected to each other with an intermediate strip of fabric. FIG. 14 is a front view of the reversible hat in a second configuration showing the second pattern corresponding to the second costume of the doll toy of FIG. 1.

Figure 17:
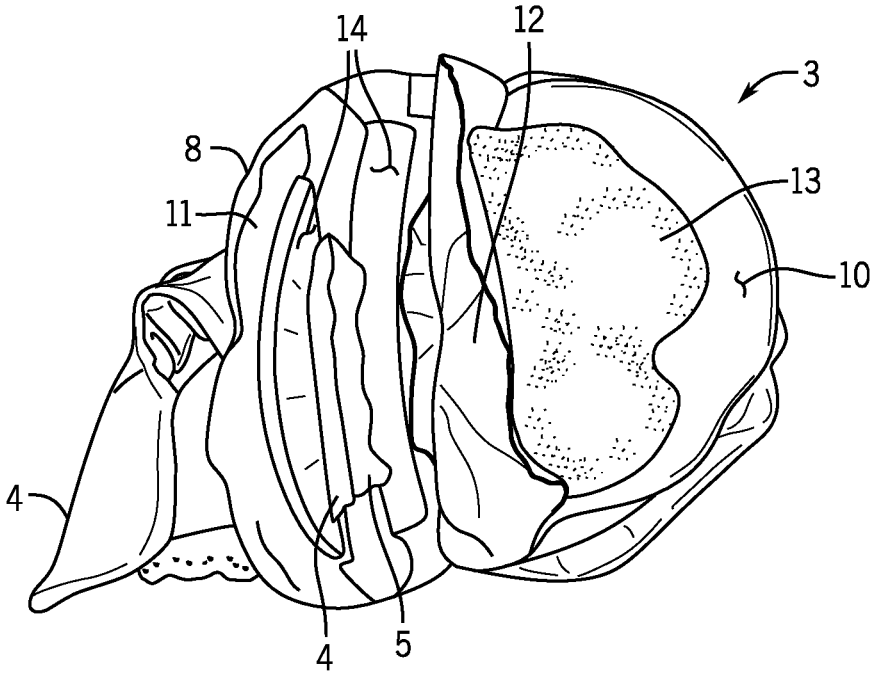
FIG. 17 is a partially exploded interior view of the shell portion of the doll toy of FIG. 1 with the first and second costumes attached.
Figure 18:
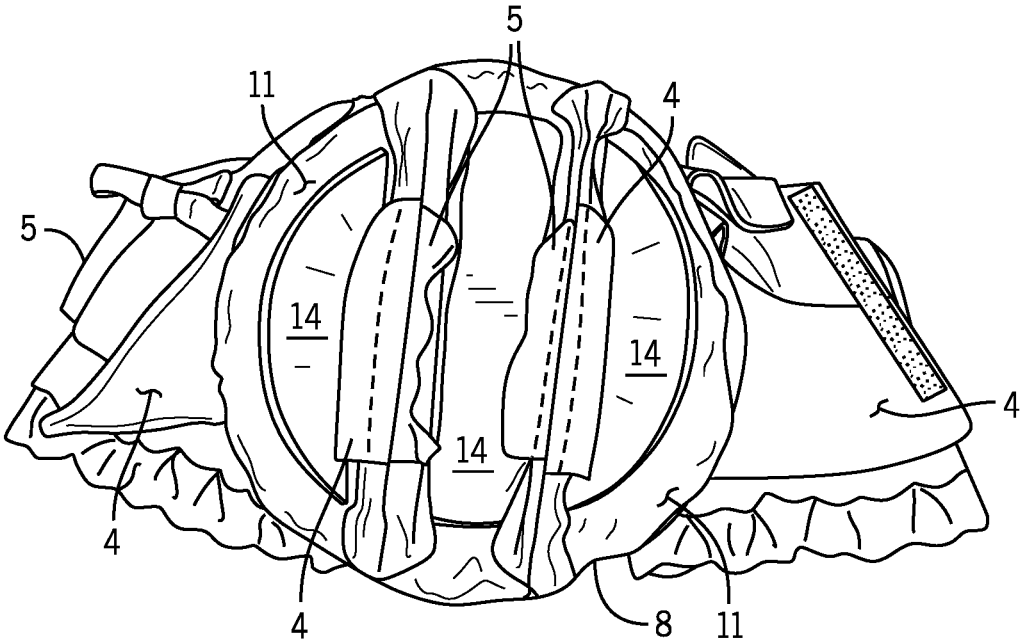
FIG. 18 is a view of the interior face of the front panel of the shell portion with the first and second costumes extended to the front side of the shell portion and showing the costumes attached to interior surfaces of the pocket adjacent the edges of the slotted openings in the front panel.

FIGS. 17 and 18 provide partially exploded and interior views of the shell portion 1 of the doll toy, showing the construction of layers within the shell portion. In one aspect these can include the pack panel 10, the stuffing material 13, the inner lining 12, and the cotton batting 11 and craft foam 14 attached to the inside of the front panel 8. Also shown are the sections of the first costume 4 and the second costume 5 attached to the interior surfaces adjacent the edges or lips of the slotted openings 6 through the front panel 8 and extended through the openings to the front of shell portion 3.

Figure 19:
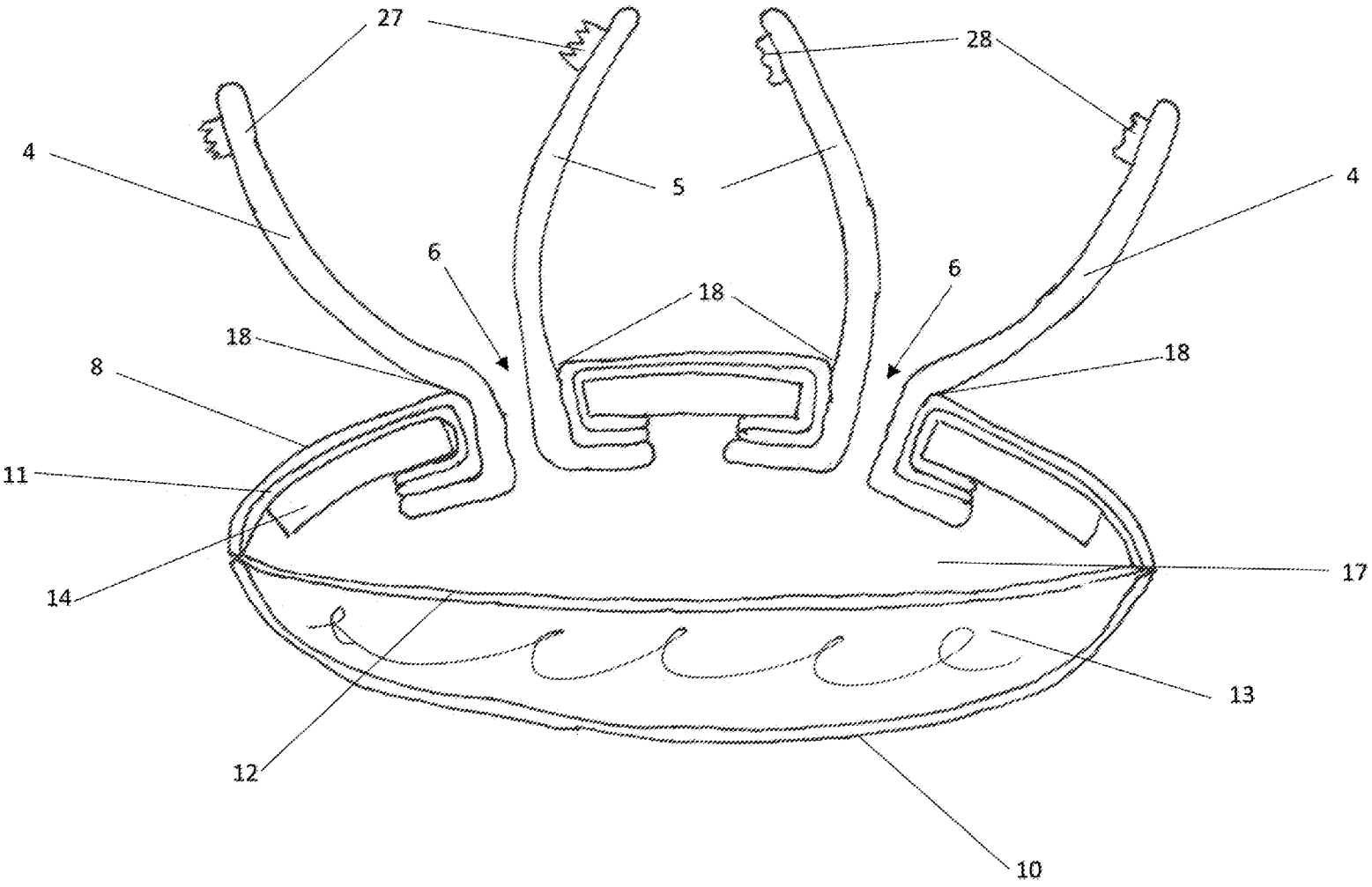
FIGS. 19 and 20 are schematic cross-sectional views of the shell portion of the doll toy of FIG. 1, as viewed from the bottom of the doll toy with the openings of the pocket oriented toward the top of the figure.

FIG. 19. is a schematic cross-sectional view of the shell portion 4 of the doll toy 1, as viewed from the bottom of the doll toy with the slotted openings 6 of the interior storage pocket 17 oriented toward the top of the drawing sheet and the back panel 10 of the shell portion 3 is oriented to the bottom of the drawing sheet. The back panel 10 of the shell portion 3, which can be made from fabric or other flexible material and can be quilted, can be sewn or otherwise connected to an inner lining 12. The space between the back panel 10 and the inner lining 12 can be filled with Poly-fil® fiber or other stuffing material 13. The back panel 10 of the shell portion 3 can also be sewn or otherwise attached to the front panel 8 of the shell portion 3 to form a complete container. In one aspect the layer of cotton batting 11 and the layer of ¼ inch craft foam 14 shown in FIGS. 17-18 can also be sewn or otherwise connected to the inner surface of the front panel 8, with the interior storage pocket 17 being defined as the space between the inner lining 12 and the craft foam layer 14.

The two sections of the first costume 4 can be sewn or otherwise attached to the interior surfaces of the pocket adjacent the outermost edges or lips 18 of the openings 6, while the two sections of the second costume 5 can be sewn or otherwise attached to the interior surfaces adjacent the innermost edges or lips 19 of the openings 6. As noted above, other arrangements are also contemplated and considered to fall within the scope of the present disclosure.

Figure 20:
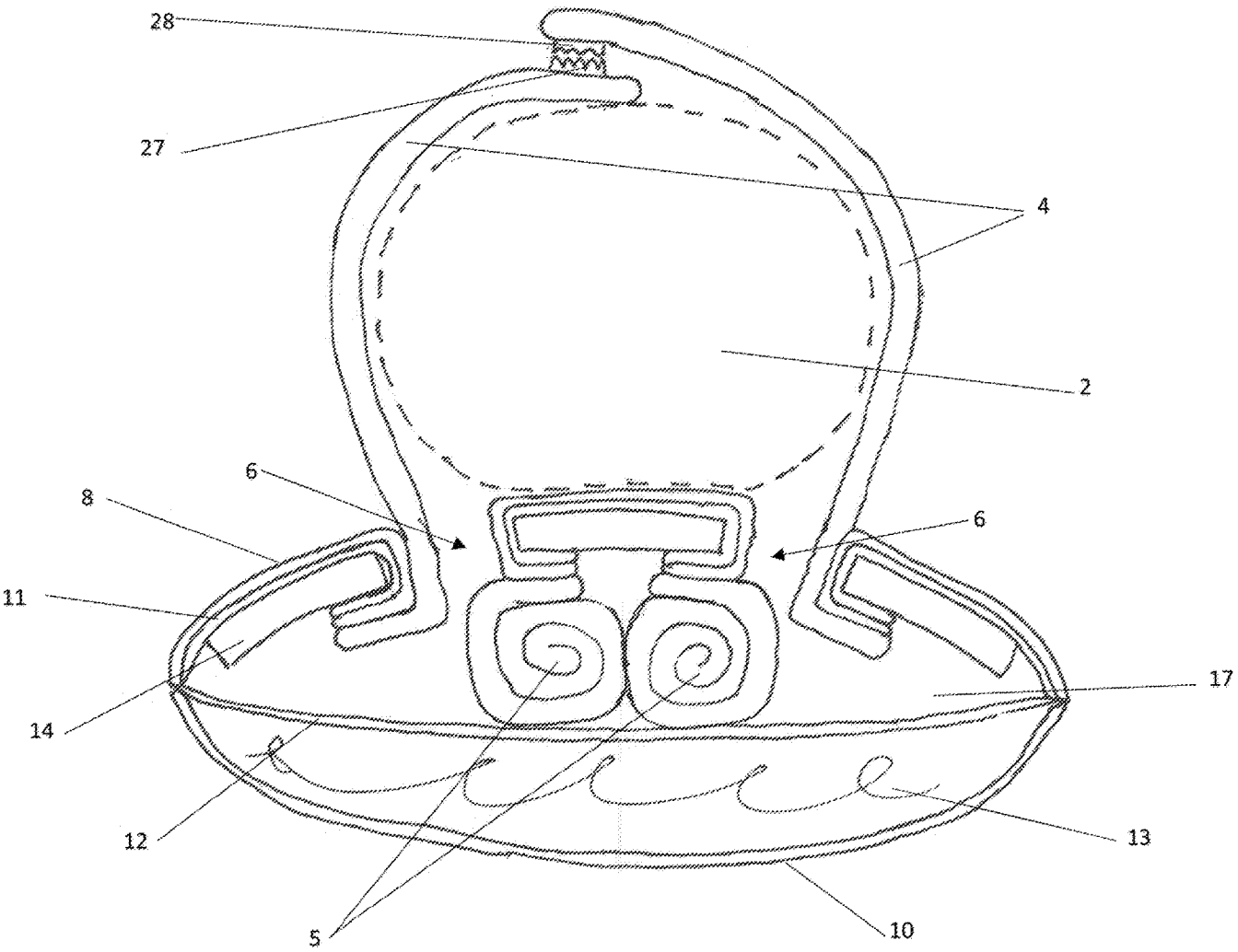

FIG. 20 another is another schematic cross-sectional view of the shell portion 3 of the doll toy 1 illustrating the doll toy dressed in a first costume 4 with the second costume 5 rolled up and retained in the interior storage pocket 17 of the shell portion. The first costume 4 is extended through the openings 6 in the shell portion and wrap around the body of the doll 2. The two sections are secured in front of the doll body by securing the "loop" configuration 28 of the Hook and loop-type closure to the "hook" configuration of the Hook and loop-type closure 27.

Figure 21:
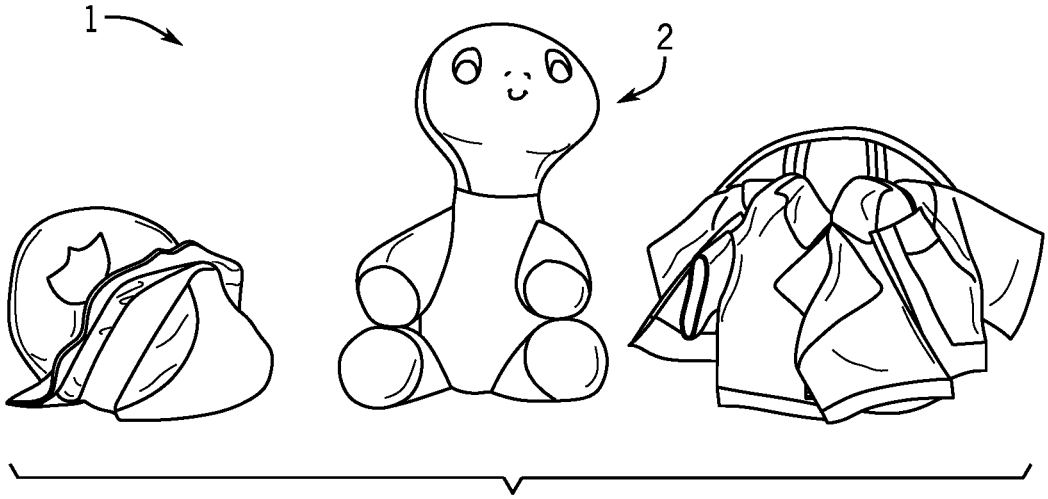
FIG. 21 is a front view of the doll figure portion of the doll toy of FIG. 1 shown with the hat and shell portion (with two different alternative costumes) separated from the doll, in accordance with another representative embodiment of the present disclosure.
Figure 22:
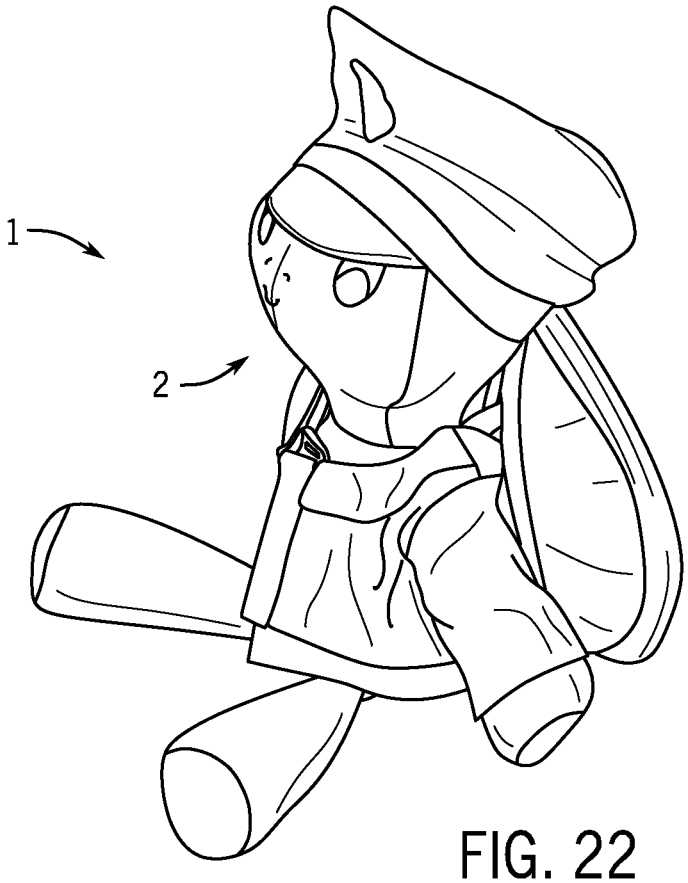
FIG. 22 is a perspective view of the doll toy of FIG. 21 in the first alternative costume.
Figure 25:
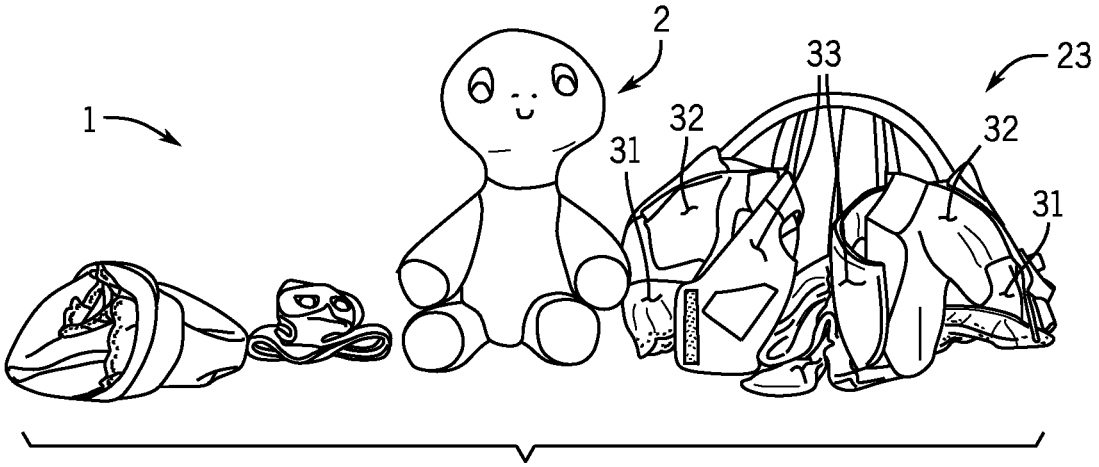
FIG. 25 is a front view of the doll figure portion of the doll toy of FIG. 1, shown with the hats and shell portion of FIG. 24 (with the three additional and different alternative costumes) separated from the doll figure.
Figure 26:
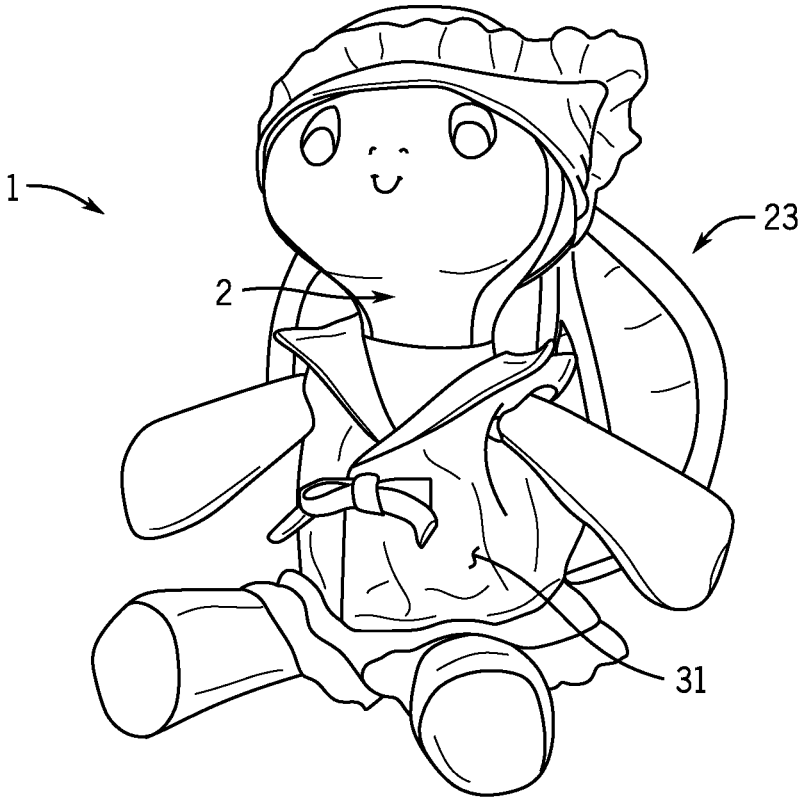
FIG. 26 is a perspective view of the three-costume version of the doll toy of FIGS. 24-25, with the doll figure dressed in the first different alternative costume.
Figure 27:
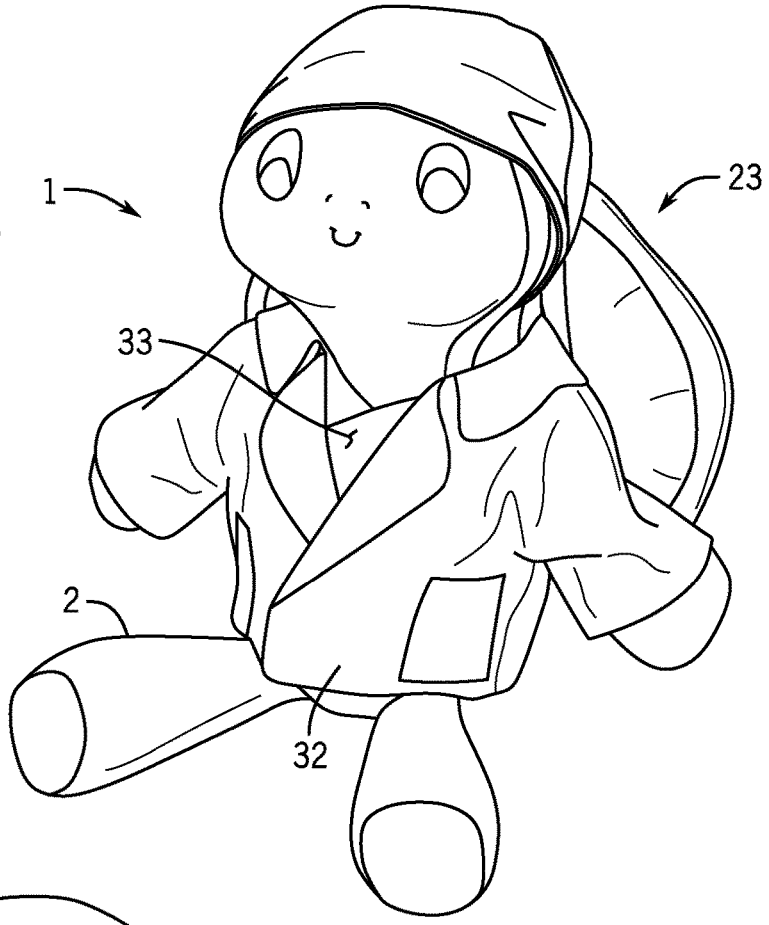
FIG. 27 is a perspective view of the three-costume version of the doll toy of FIGS. 24-25, with the doll figure dressed in the second and third different alternative costumes.
Figure 28:
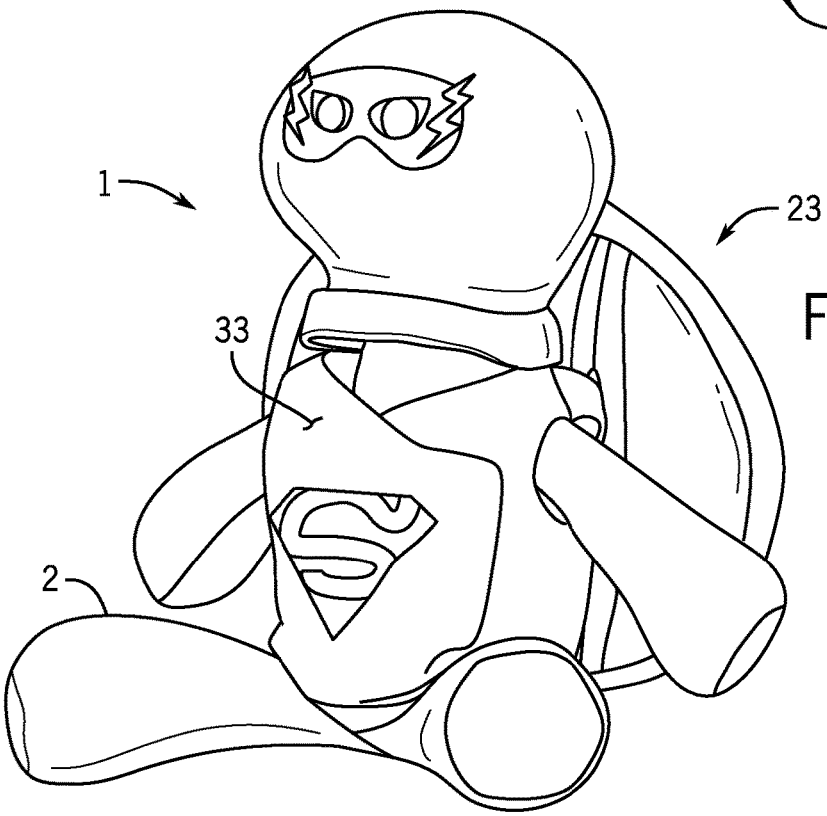
FIG. 28 is a perspective view of the three-costume version of the doll toy of FIGS. 24-25, with the doll figure dressed in the third different alternative costume.

FIGS. 21, 22, and 23 are views of a doll toy providing examples of alternate costumes which can be attached to the shell portion.

FIG. 24 is a front view of an alternative embodiment of the shell portion 23 of the doll toy having three slotted openings formed through the front panel 24, namely two outer openings 25 and a center opening 26 to the interior storage pocket, with three costumes 31, 32, 33 being retained within the pocket. In this embodiment, the two sections of the first costume 31 can be sewn or otherwise attached to the interior surfaces of the pocket adjacent the outermost edges or lips 27 of the outer openings 25 through the front panel 24, while the two sections of the second costume 32 and the top sections of the third costume 33 can be sewn or otherwise attached to the interior surfaces adjacent the innermost edges or lips 28 of the outer openings 25. The bottom section of the third costume 20 can be sewn or otherwise attached to the interior surfaces on either side of the center opening to the interior storage pocket.

During play, the first and second costumes 31, 32 can be utilized as previously described. The top sections of the third costume 33 can be worn by the doll toy underneath the sections of the second costume 32 when the second costume is utilized. Alternatively, they can be folded and concealed between the doll FIG. 2 and the front panel 24 of the shell portion 23. When the third costume 32 is utilized, the first and second costumes 31, 32 and the corresponding reversible hat 34 can be rolled or folded and stored within the interior storage pocket 30 of the shell portion 23. The top and bottom sections of the third costume 32 can be placed on the doll 2 and secured in front with a closure or fastener, such as snaps, buttons, a hook and loop-type closure (e.g. a Velcro® closure), a zipper, or any other type of fabric closure or fastener known in the art. A hat or mask corresponding to the third costume can be placed on the head of the doll 2.

FIGS. 25-28 are views of the doll figure portion 2 of FIG. 1 together with the alternative embodiment of the shell portion 23 of FIG. 24, showing examples of three attached costumes in each of the three configurations described above. It will be appreciated that the arrangements of the slotted openings and various costumes are merely representative in nature, and that alternative arrangements for the slotted openings and costumes are also contemplated and considered to fall within the scope of the present disclosure.

Figure 29:
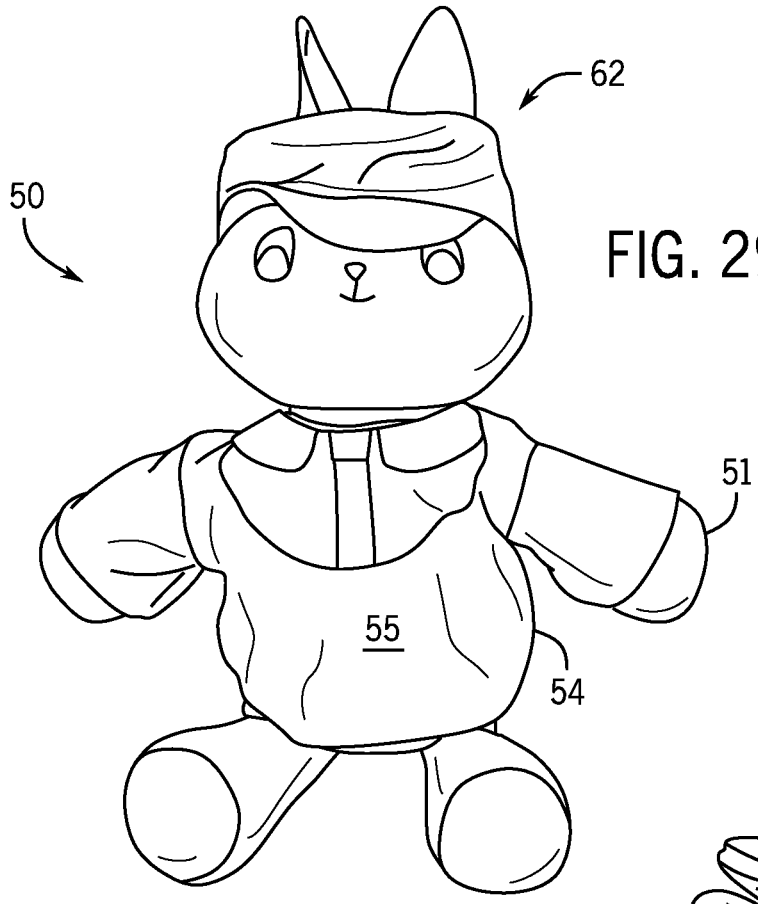
FIG. 29 is a front view of the doll toy in a first reversible costume, in accordance with another representative embodiment of the present disclosure in which the body of the doll toy comprises a doll figure portion representative of a rabbit.
Figure 30:
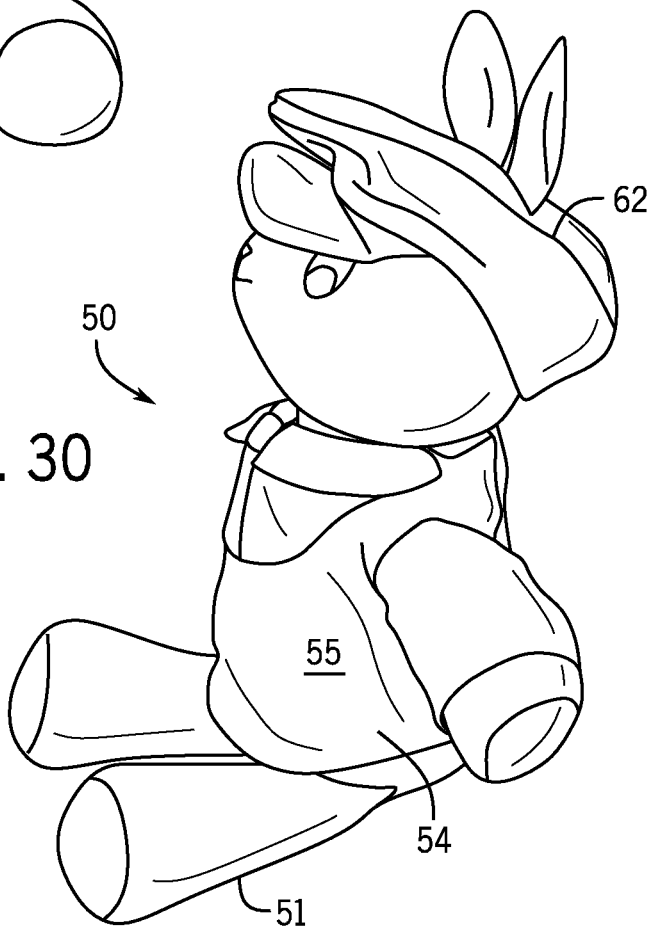
FIG. 30 is a side view of the doll toy of FIG. 29 dressed in the first reversible costume.
Figure 31:
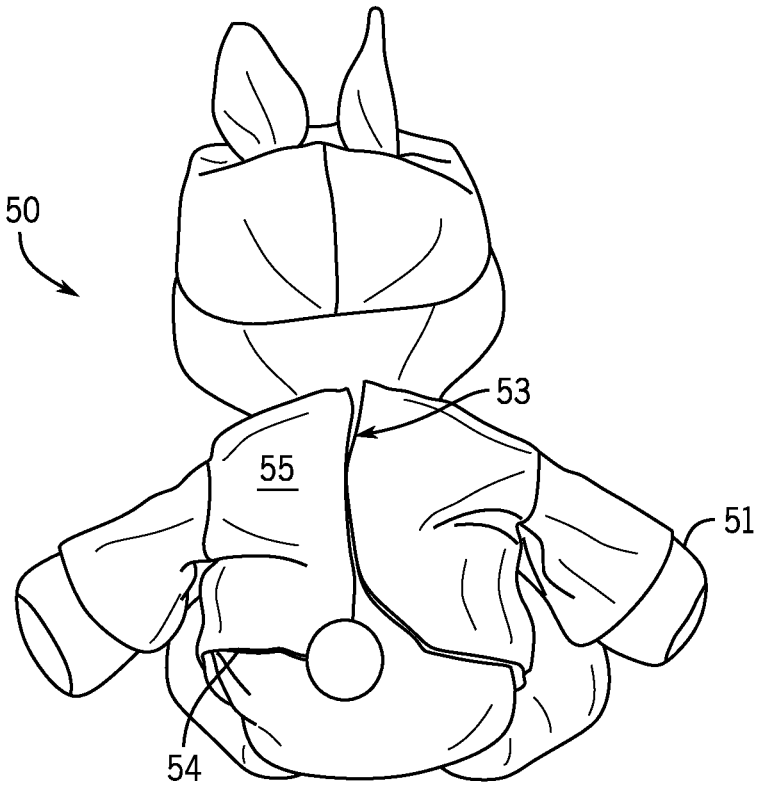
FIG. 31 is a back view of the doll toy of FIG. 29 dressed in the first reversible costume.

Another representative embodiment of the doll toy 50 of the present disclosure is shown in FIGS. 29-31, in which the body of the doll toy 50 comprises a doll figure portion 51 which, in one aspect, can be representative of a rabbit. The doll toy 50 of FIGS. 29-31 may not include a removable shell, but instead can have an interior cavity or interior storage pocket contained within and opening to the back of the doll figure portion 51, with multiple reversible outfits or costumes attached to interior surfaces of the pocket adjacent one or more openings to the interior pocket, such slotted opening 53. As shown in the drawings, for example, the doll toy 50 can be dressed in a first reversible garment 54 having a single first or inner edge portion attached to the interior surfaces of the pocket on either side of the opening 53 to the interior storage pocket, and a single second panel portion wrapped around the doll figure portion 51 of the doll toy, and secured at an outer edge to the back of the doll figure portion 51 with a closure, such as the hook and loop-type closure described above. In one aspect the first reversible garment 54 can comprise a first costume 55 and a second costume 56. As discussed below, a second reversible garment 57 can also be attached to the interior surface on the opposite side of the slotted opening 53 that can include a third costume 58 and a fourth costume 59, and which second reversible garment 57 can be retained in the cavity or pocket in the doll figure portion 51 when the doll toy 50 is dressed in the first reversible garment 54.

Figure 32:
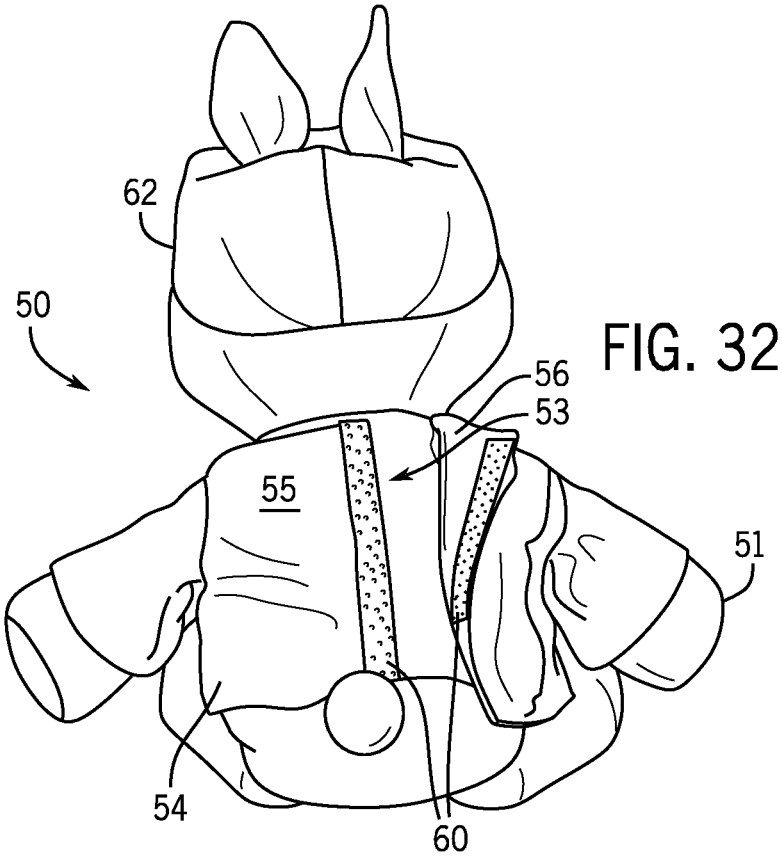
FIG. 32 is another back view of the doll toy of FIG. 29 dressed in the first reversible costume showing the Hook and loop-type closure opened in preparation for dressing the doll toy 50 in a second reversible costume.
Figure 33:
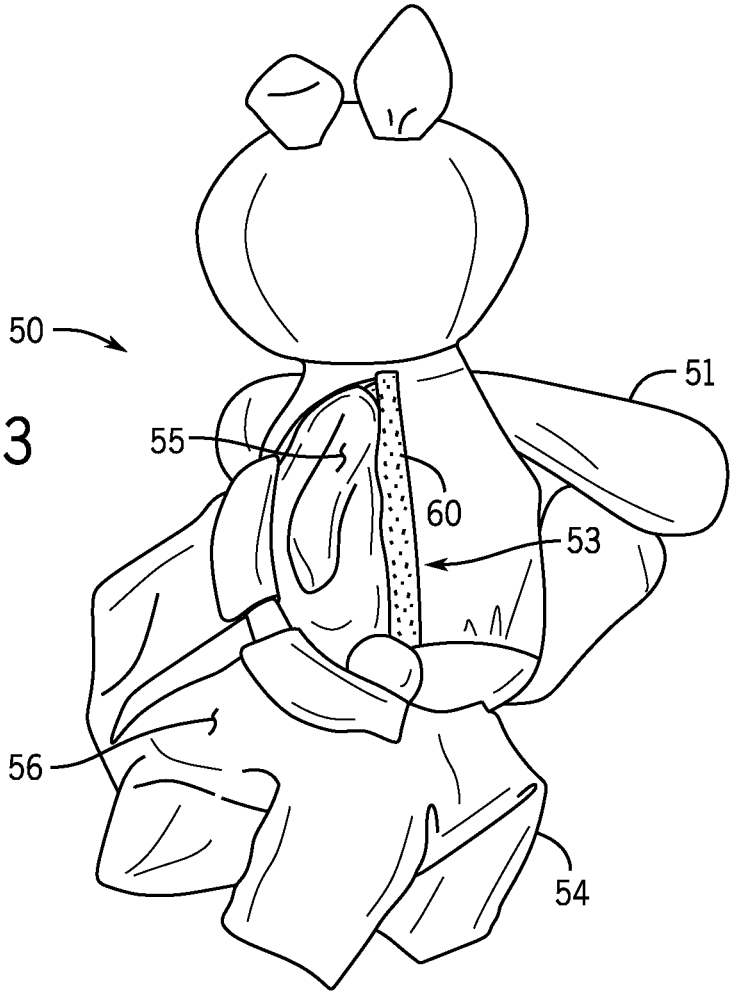
FIG. 33 is another back view of the doll toy of FIG. 29 with the first and second reversible costumes extended in preparation for dressing the doll toy 50 in a second costume.

FIGS. 32-33 are a back views of the doll figure portion 51 of the rabbit embodiment of the doll toy 50 having the interior cavity or pocket contained therein and opening to the back of the doll figure portion 51, as described above, and which is dressed in a first configuration showing the first costume 55 of the first reversible garment 54. During play, the first reversible garment 54 can be reversed to a second configuration presenting the second costume 56 by unfastening the closure 60 and removing the first reversible garment 54 from the arms of the doll figure portion 51. For example, FIG. 32 is a back view of the doll figure portion 51 with the closure 60 unfastened in preparation for transitioning to the second costume 56. The first reversible garment 54 can then be unwrapped in the opposite direction and re-wrapped by placing over the arms and passing around the front of the doll figure portion 51, after which it can be secured at the back of the doll figure portion 51 with the closure in the second configuration presenting the second costume 56. FIG. 33 is a back view of the doll toy 50 showing the first reversible garment 54 showing the second costume 56 as it is being re-positioned or re-wrapped around the doll figure portion 51. During the re-wrapping the first reversible garment 54 can be placed over the arms and wrapped around the front of the doll figure portion 51 and secured at the back of the doll toy with the closure 60.

Figure 34:
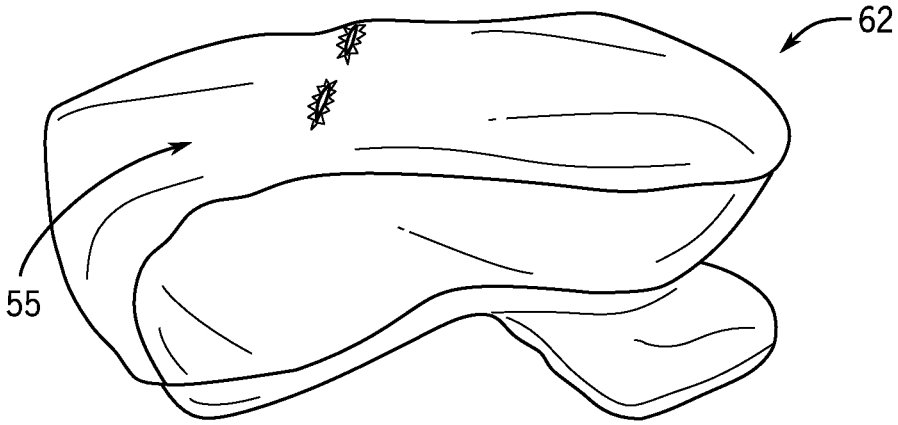
FIG. 34 is a side view of the reversible hat of FIG. 29 in a first configuration showing a first pattern or arrangement corresponding to the first reversible costume of the doll toy.
Figure 35:
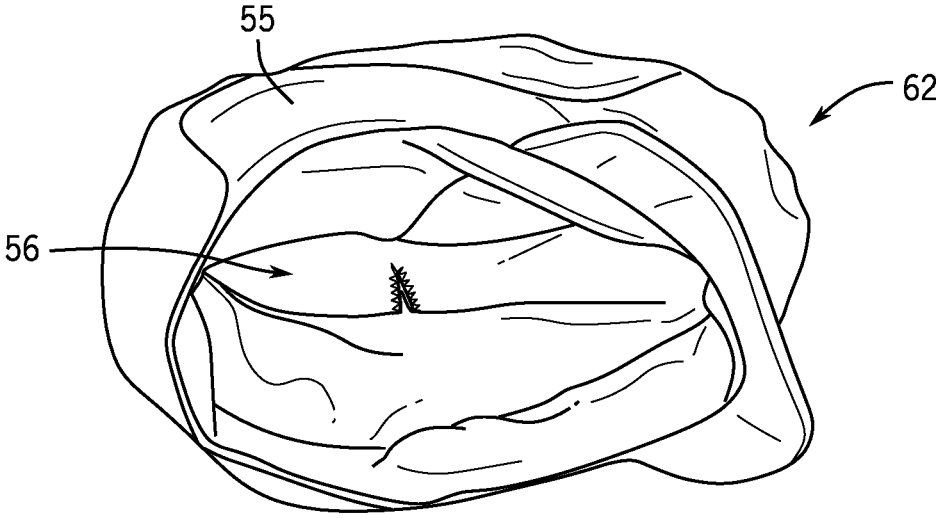
FIG. 35 is a bottom view of the reversible hat of FIG. 29 in a first configuration showing the first pattern or arrangement corresponding to the first costume on the outside and the second pattern or arrangement corresponding to the second reversible costume on the inside.
Figure 36:
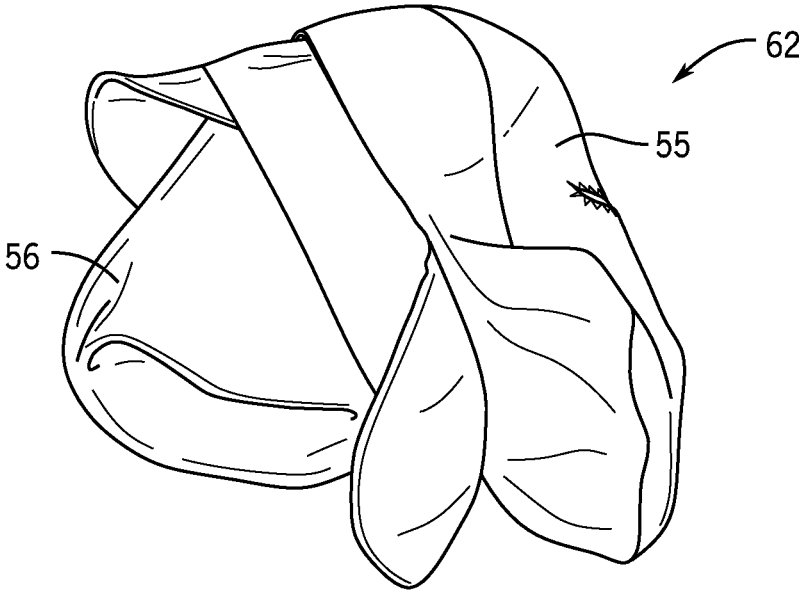
FIG. 36 is a side view of the reversible hat of FIG. 29 in a partial inside-out configuration, with the patterns for both of the first and second reversible costumes being visible.
Figure 37:
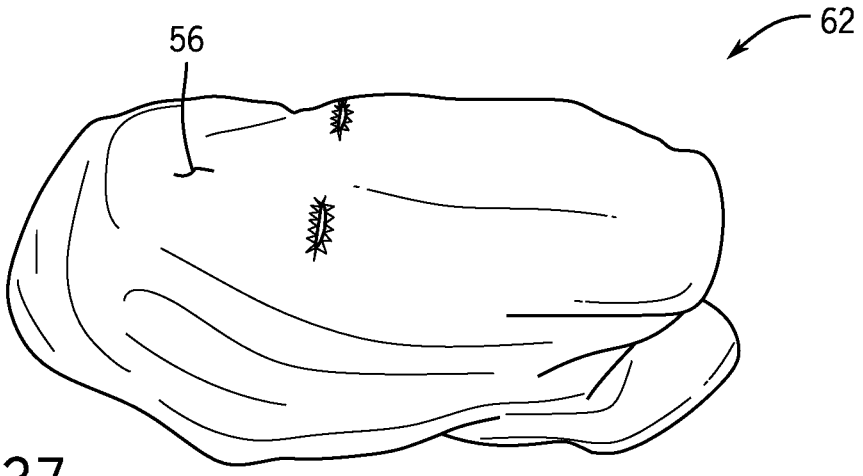
FIG. 37 is a side view of the reversible hat in the second configuration showing the second pattern or arrangement corresponding to the second reversible costume of the doll toy.

Similar to the first embodiment of the doll toy 1 described above, FIGS. 34-37 are progressive views of the reversible hat 62 of the second embodiment 50 illustrating the reconfiguration from the first costume 55 to the second costume 56. In particular, FIG. 34 is a perspective view of the reversible hat 62 in a first configuration showing a first pattern or arrangement corresponding to the first costume 55 of the doll toy 50. FIG. 35 is a bottom view of the reversible hat in the first configuration with the second pattern or arrangement of the reversible hat corresponding to the second costume 56 of the doll toy 50 being visible within the reversible hat 62. FIG. 36 is a side view of the reversible hat 62 in a partial inside-out configuration, with the fabric panels showing the patterns corresponding to the first and second costumes extended from each other and which can be sewn or otherwise connected to each other with an intermediate strip of fabric. FIG. 37 is a side view of the reversible hat 62 in the second configuration showing the second pattern corresponding to the second costume 56 of the doll toy 50.

Figure 38:
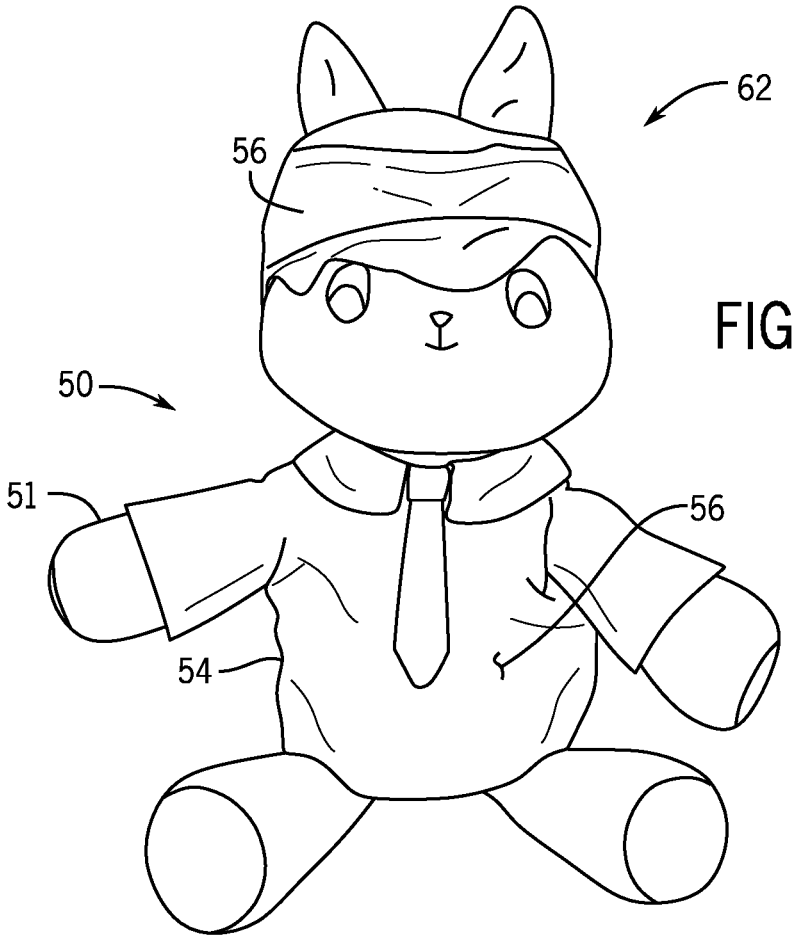
FIG. 38 is a front view of the doll toy of FIG. 29 dressed in the second reversible costume.
Figure 39:
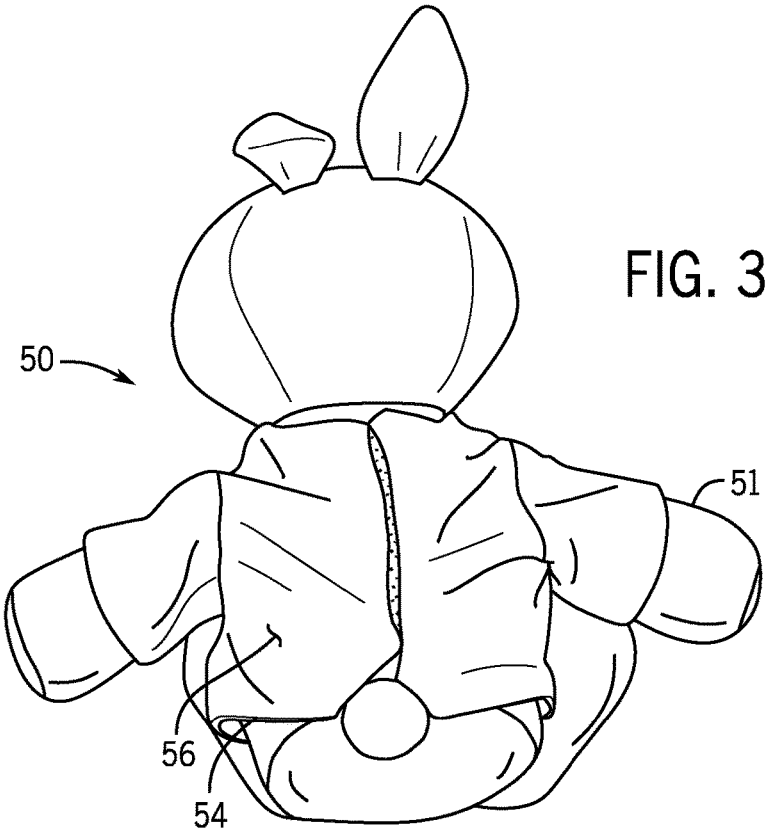
FIG. 39 is a back view of the doll toy of FIG. 29 in the second reversible costume.

FIGS. 38 and 39 are views of the doll toy 50 fully dressed in the first reversible garment 54 that has been wrapped around the doll figure portion 51 in the second configuration so as to present the second costume 56, and also includes the reversible hat 62 in the second configuration showing the second pattern corresponding to the second costume 56.

Figure 40:
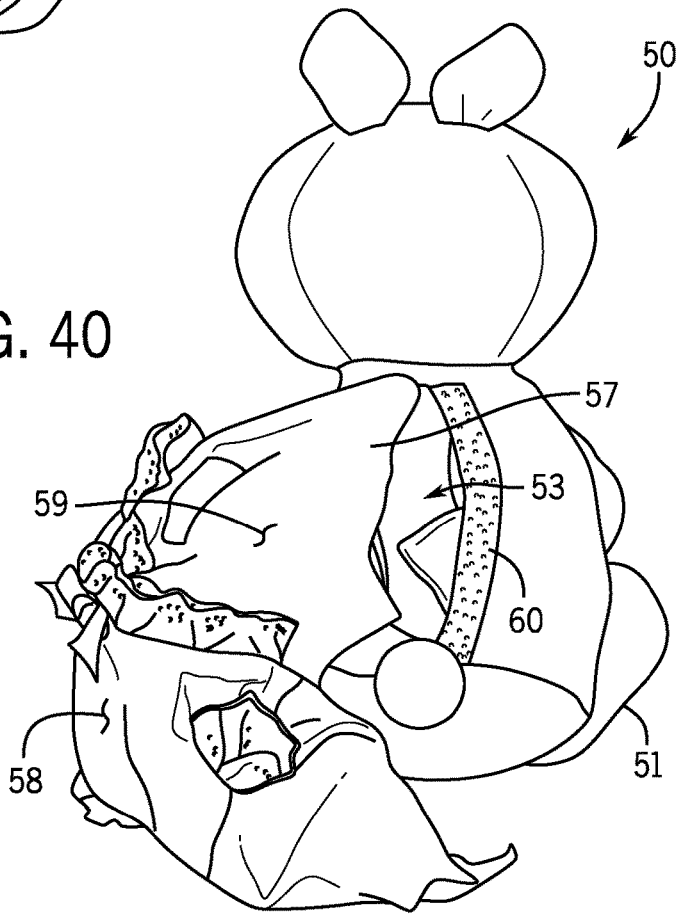
FIG. 40 is a back view of the doll toy of FIG. 29 with the third and fourth reversable costumes extended in preparation for dressing the doll toy 50 in the third reversible costume.
Figure 43:
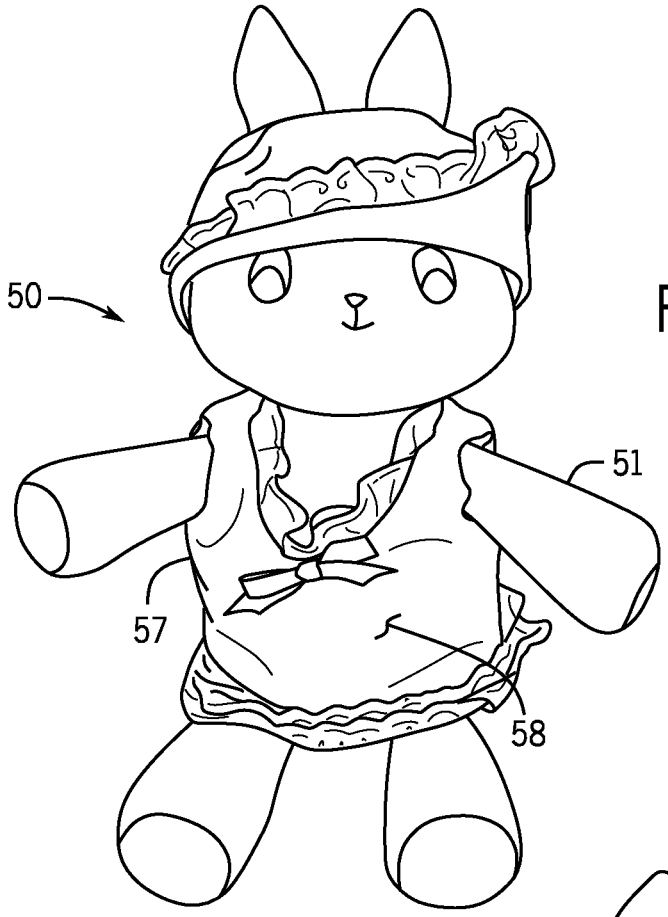
FIG. 43 is a front view of the doll toy of FIG. 29 dressed in the third reversible costume.
Figure 44:
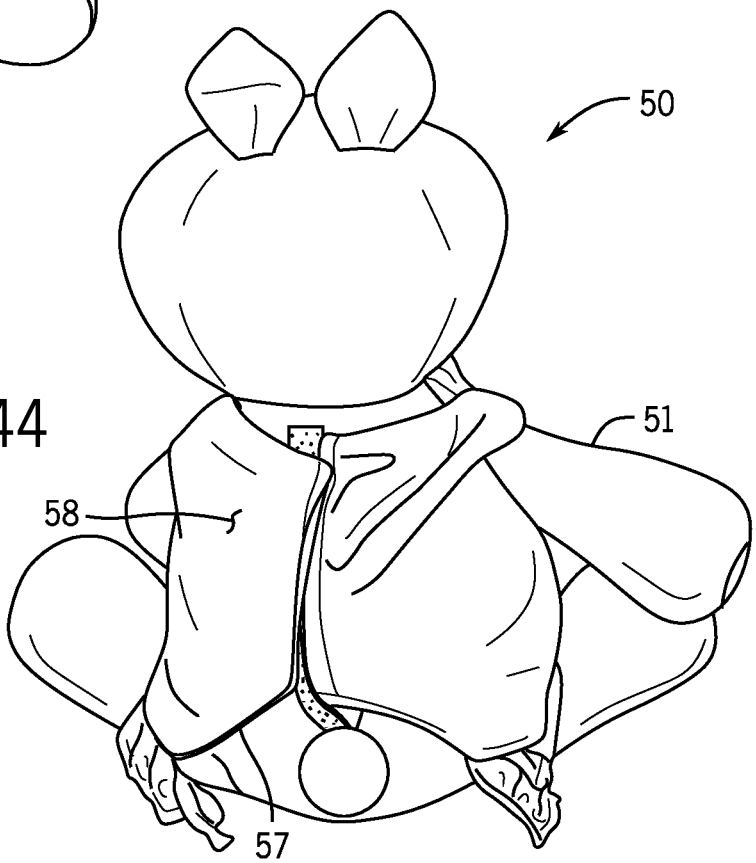
FIG. 44 is a back view of the doll toy of FIG. 29 dressed in the third reversible costume.

As noted above, the second reversible garment 57 that includes a third costume 58 and a fourth costume 59 can be utilized by unfastening the closure 60 of the first reversible garment 54, which can be rolled or folded and placed in the internal cavity or pocket 52 in the doll figure portion 51. The second reversible garment 57 can be extended from the pocket 52 and then be wrapped placed over the arms around the front of the doll figure portion 51 into a first configuration presenting the third costume 58. For example, FIG. 40 is a back view of the doll toy 50 showing the second reversible garment 57 being positioned on the doll toy 50 to present the third costume 58, while the first reversible garment 54 is retained inside the pocket 52 of the doll figure portion 51. FIGS. 43 and 44 are additional views of the doll toy 50 dressed in the second reversible garment 57 that has been wrapped around the doll figure portion 51 in the first configuration so as to present the third costume 58, and also includes another reversible hat 63 in a first configuration showing the third pattern corresponding to the third costume 58.

Figure 45:
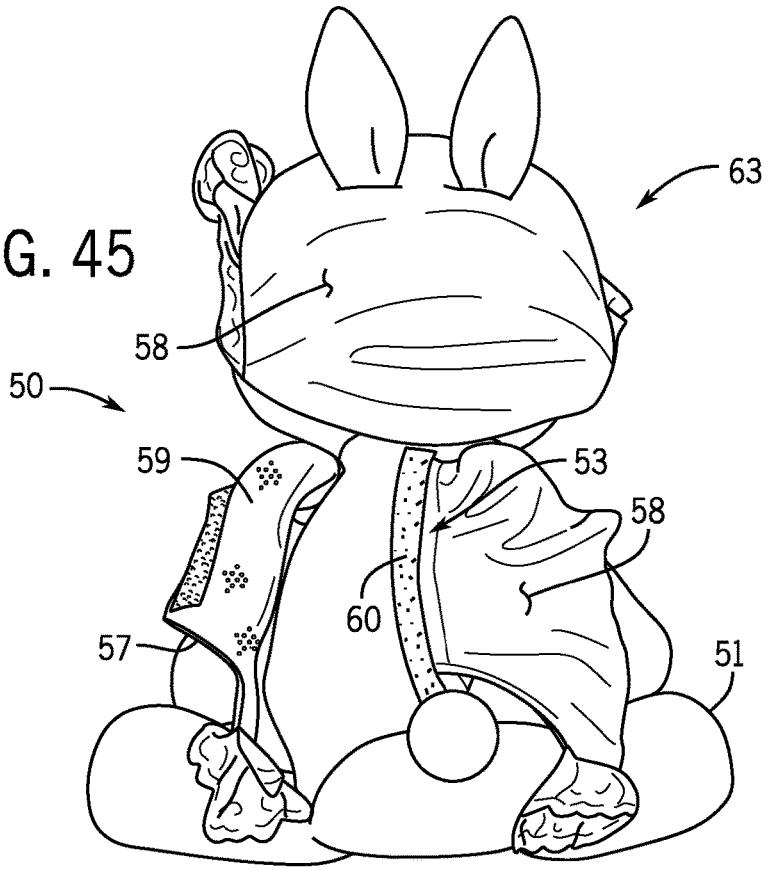
FIG. 45 is a back view of the of the doll toy of FIG. 29 dressed in the third reversible costume, and showing the Hook and loop-type closure opened in preparation for dressing the rabbit in the fourth reversible costume.

The second reversible garment 57 can likewise be reversed to a second configuration to present the fourth costume 59 by unfastening the closure 60 and removing the second reversible garment 57 from the arms of the doll figure portion 51. FIG. 45 is a back view of the doll toy 50 with the closure 60 unfastened in preparation for transitioning from the third costume 58 to the fourth costume 59. The second reversible garment 57 can be unwrapped in the opposite direction and re-wrapped by placing over the arms and passing around the front of the doll figure portion 51, after which it can be secured at the back of the doll figure portion 51 with the closure 60 in the second configuration presenting the fourth costume 59.

Figure 41:
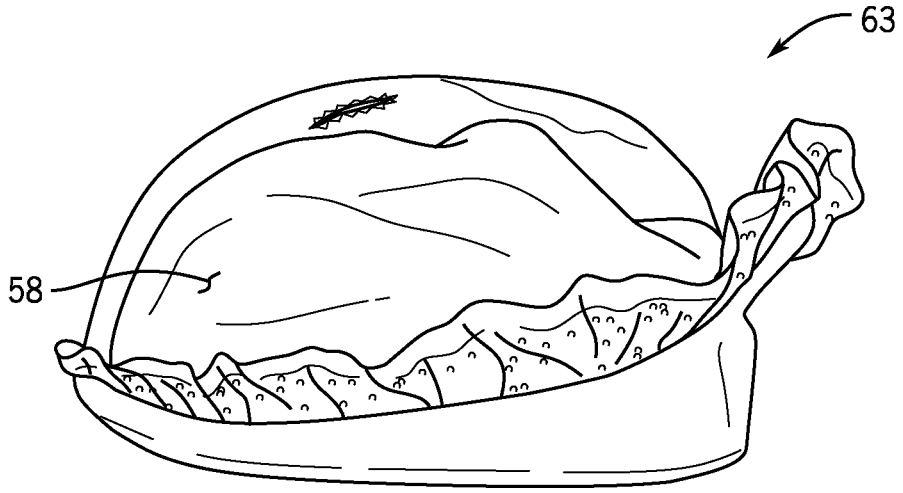
FIG. 41 is a side view of a reversible hat corresponding to the third reversible costume of the doll toy of FIG. 29.
Figure 42:
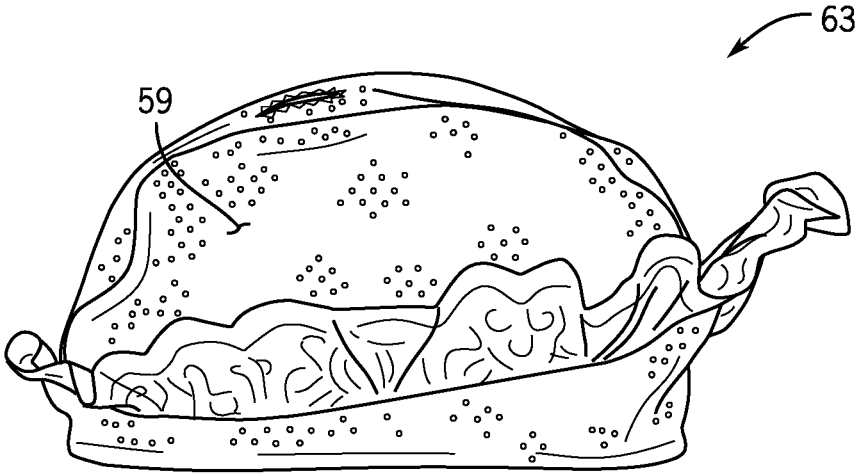
FIG. 42 is a side view of a reversible hat corresponding to the fourth reversible costume of the doll toy of FIG. 29.
Figure 46:
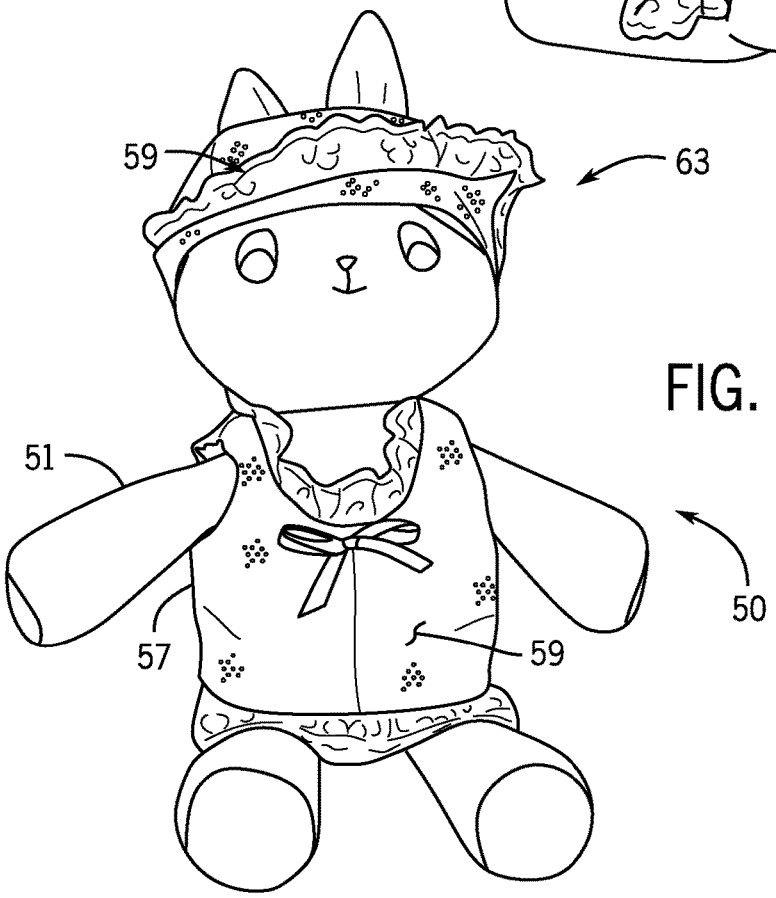
FIG. 46 is a front view of the doll toy of FIG. 29 dressed in the fourth reversible costume.

FIG. 46 is a front view of the doll toy 50 fully dressed in the fourth costume 59. The reversible hat 63 showing a second pattern or arrangement corresponding to the fourth costume 59 can also be placed on the head of the doll toy 50. FIGS. 41 and 42 are front views of the reversible hat 63 in configurations presenting the patterns corresponding to the third costume 58 and the fourth costume 59, respectively 60.

Figure 47:
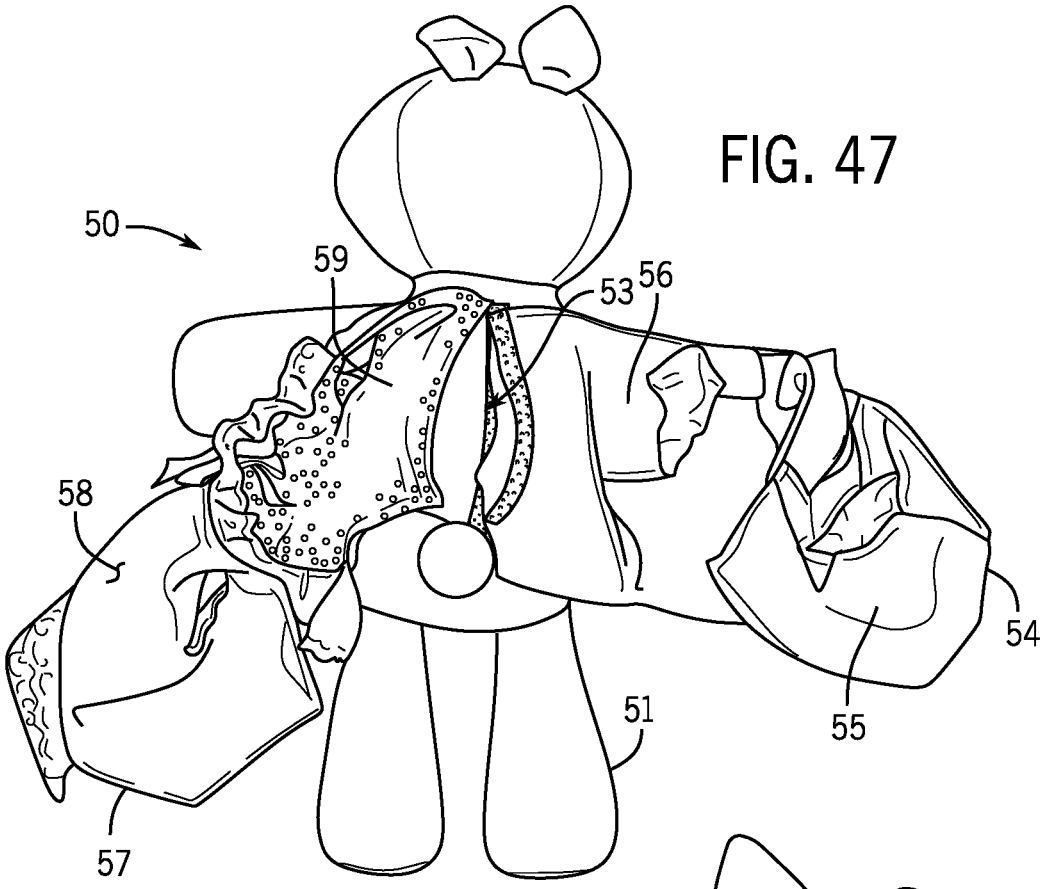
FIG. 47 is a back view the doll toy of FIG. 29 with both sets (first and second, third and fourth) of reversible costumes extended from the pocket in the doll figure portion of the doll toy.
Figure 48:
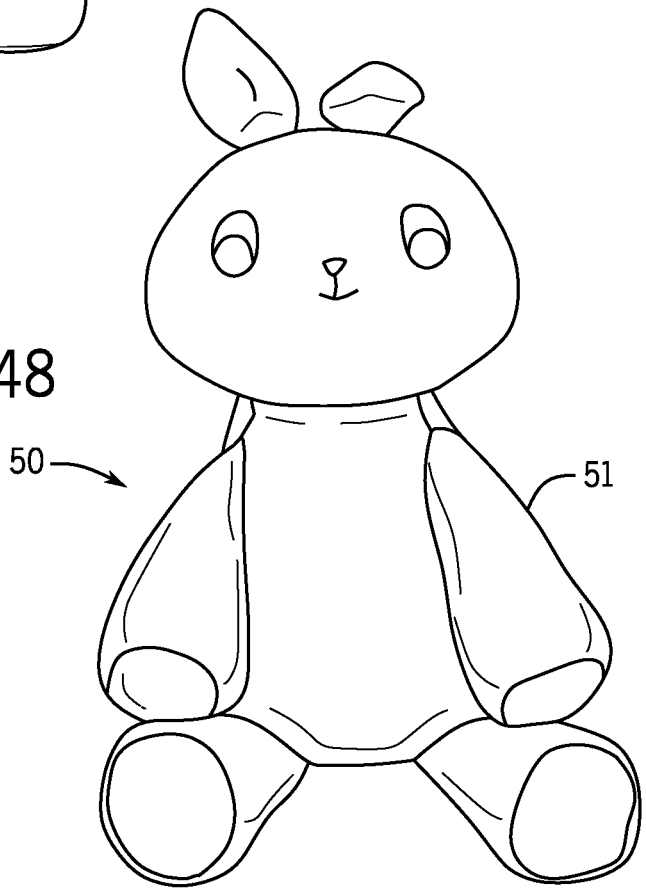
FIG. 48 is a front view of the doll toy of FIG. 29 showing the doll figure portion and with all the reversible costumes stored within the doll figure portion of the doll toy.

FIG. 47 is a back view of the doll toy 50 with both reversible garments 54, 57 extended from the internal pocket 52 through the slotted opening 56 in the back of the doll figure portion 51. FIG. 48 is a front view of the undressed doll toy 50 with both reversible garments and both reversible hats retained within the pocket of the doll toy and secured at the back of the doll toy with the closure.

Figure 49:
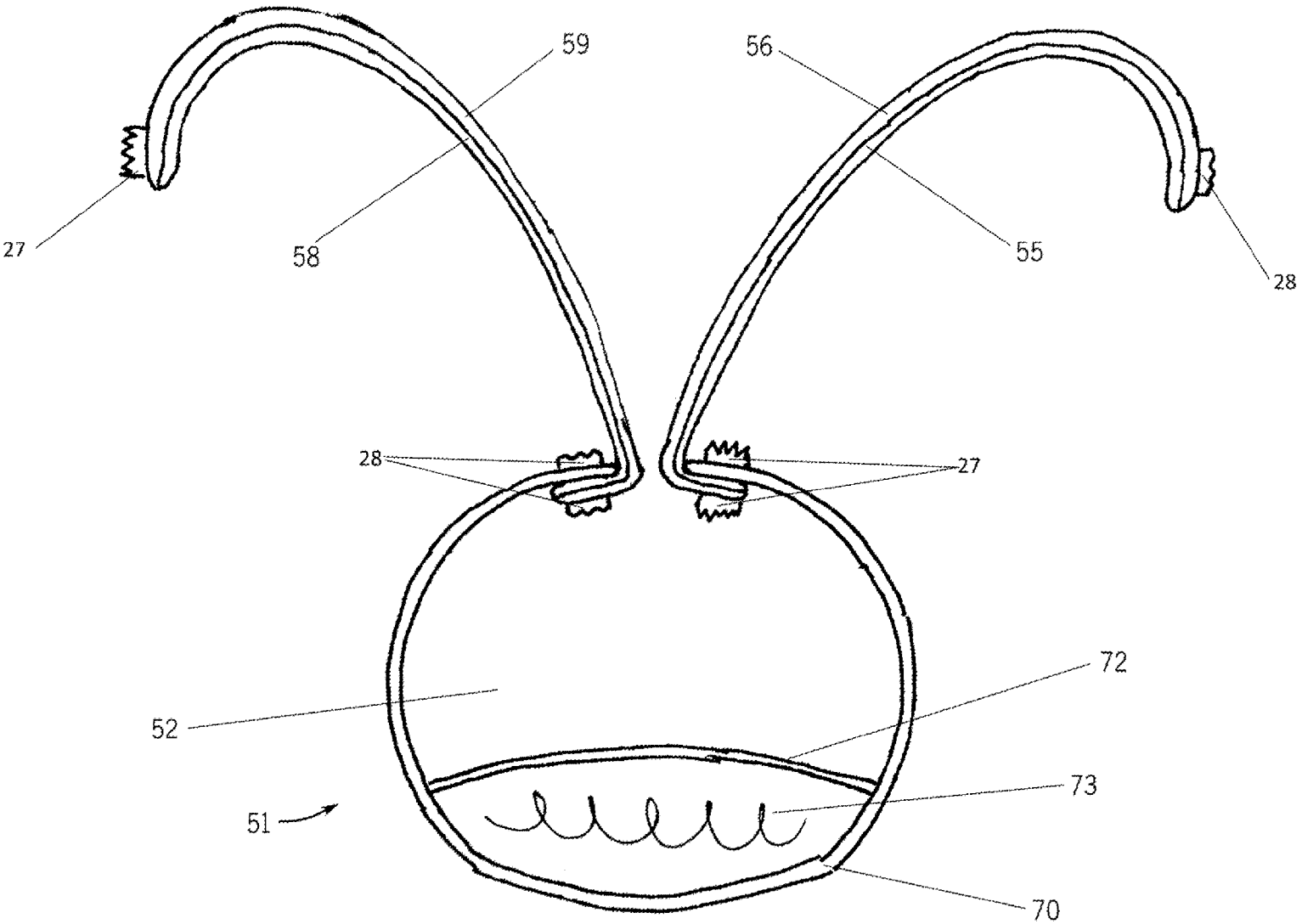
FIG. 49-51 are schematic cross-sectional views of the doll toy 50 viewed from the bottom of the doll toy with the back opening of the interior storage pocket doll figure portion oriented toward the top of the drawing sheet The foregoing and other objects, features, and advantages of the present disclosure set forth herein will be apparent from the following description of particular embodiments of those inventive concepts, as illustrated in the accompanying drawings. It should be noted that the drawings are not necessarily to scale; however, the emphasis instead is being placed on illustrating the principles of the inventive concepts. Also, in the drawings the like reference characters may refer to the same parts or similar throughout the different views. It is intended that the embodiments and figures disclosed herein are to be considered illustrative rather than limiting.

FIG. 49 is a schematic cross-sectional view of the doll figure portion 51 of the doll toy 50 viewed from the bottom of the doll toy with the opening 53 of the interior storage pocket 52 oriented toward the top of the drawing sheet. The outer layer of the doll figure portion 51 can be made out of fabric 70 or other flexible material. An inner lining 72 within the doll figure portion creates a space, which can be filled with Poly-fil® fiber or other stuffing material 73 to create the soft bodied doll. The interior storage pocket 52 of the doll figure portion 51 is formed between the inner lining 72 and the outer fabric 70 of the doll toy. The reversible garments 54, 57 can be sewn or otherwise attached to the interior surfaces adjacent the edges or lips of the slotted opening 53 to the interior storage pocket 52.

In embodiments where the closure 60 is a hook and loop-type closure, strips of the "hook" portion 27 of the closure 60 can be positioned on the outer and inner surfaces adjacent the edge or lip of the slotted opening 53 to which the inner edge of the first reversible garment 54 is attached. A strip of the "loop" portion 28 of the closure can be positioned at the outer edge of the first reversible garment 54 on the side of the second costume 56. Likewise, strips of the "loop" portion 28 of the closure 60 can be positioned on the outer and inner surfaces adjacent the edge or lip of the slotted opening 53 to which the inner edge of the second reversible garment 57 is attached, and a strip of the "hook" portion 27 of the closure 60 can be positioned on the outer edge of the second reversible garment 57 on the side of the third costume side 58.

Figure 50:
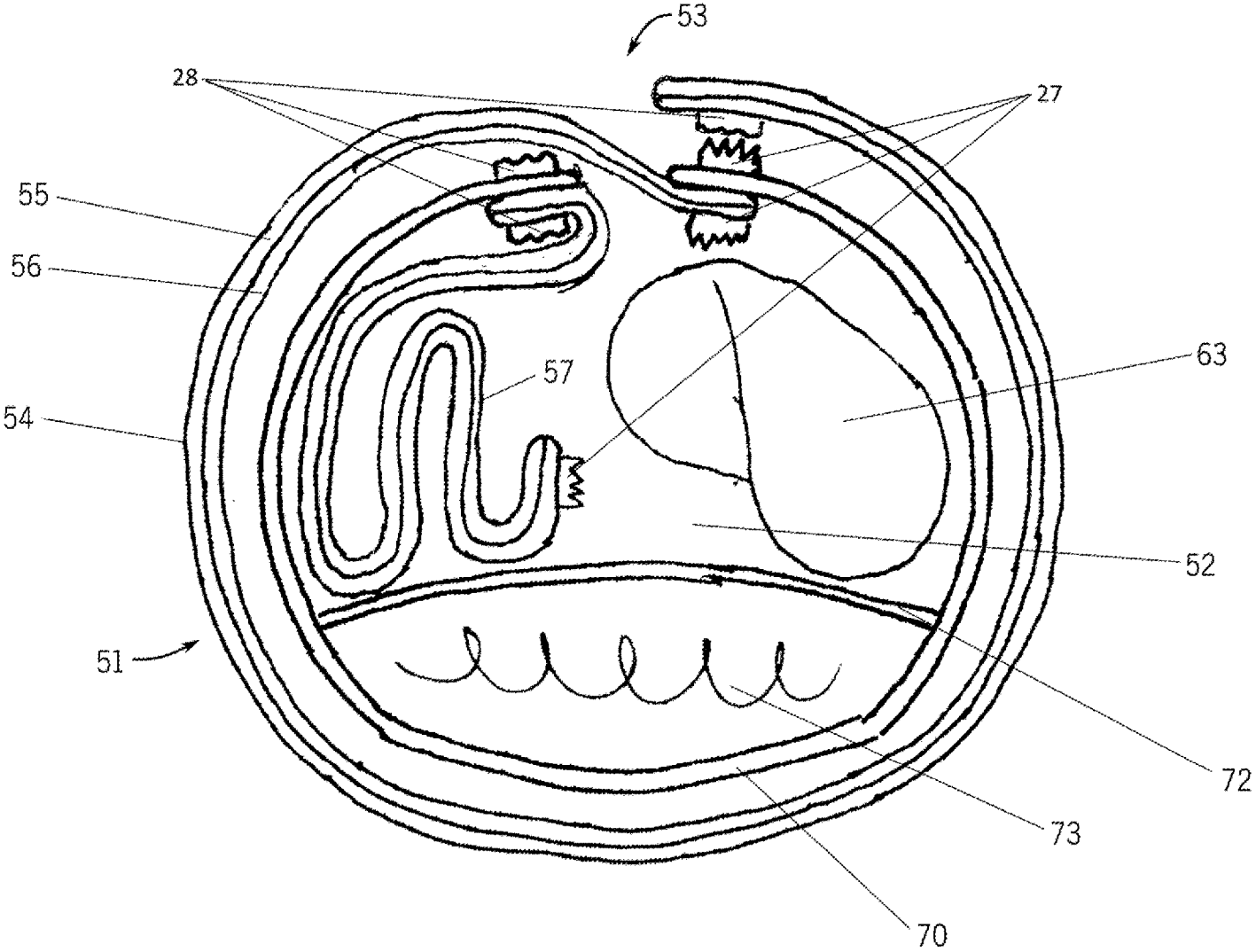

FIG. 50 is a schematic cross-sectional view of the doll figure portion 51 viewed from the bottom of the doll toy 50 with the opening 53 to the interior storage pocket 52 oriented toward the top of the drawing sheet, and showing the doll toy 50 in a first costume 55. In this configuration the first reversible garment 54 can be passed through and across the opening 53 of the interior storage pocket 52 and wrapped counter-clockwise around the doll figure portion 51. The first reversible garment 54 can be secured with the hook and loop-type closure utilizing the "hook" configuration 27 on the outside of the edge or lip of the opening 53 to which the reversible garment is attached and the "loop" configuration on the side of the second costume 56 of the reversible garment 54. The second reversible garment 57 and second reversible hat 63 are shown within the interior storage pocket 52 in the doll figure portion 51.

Figure 51:
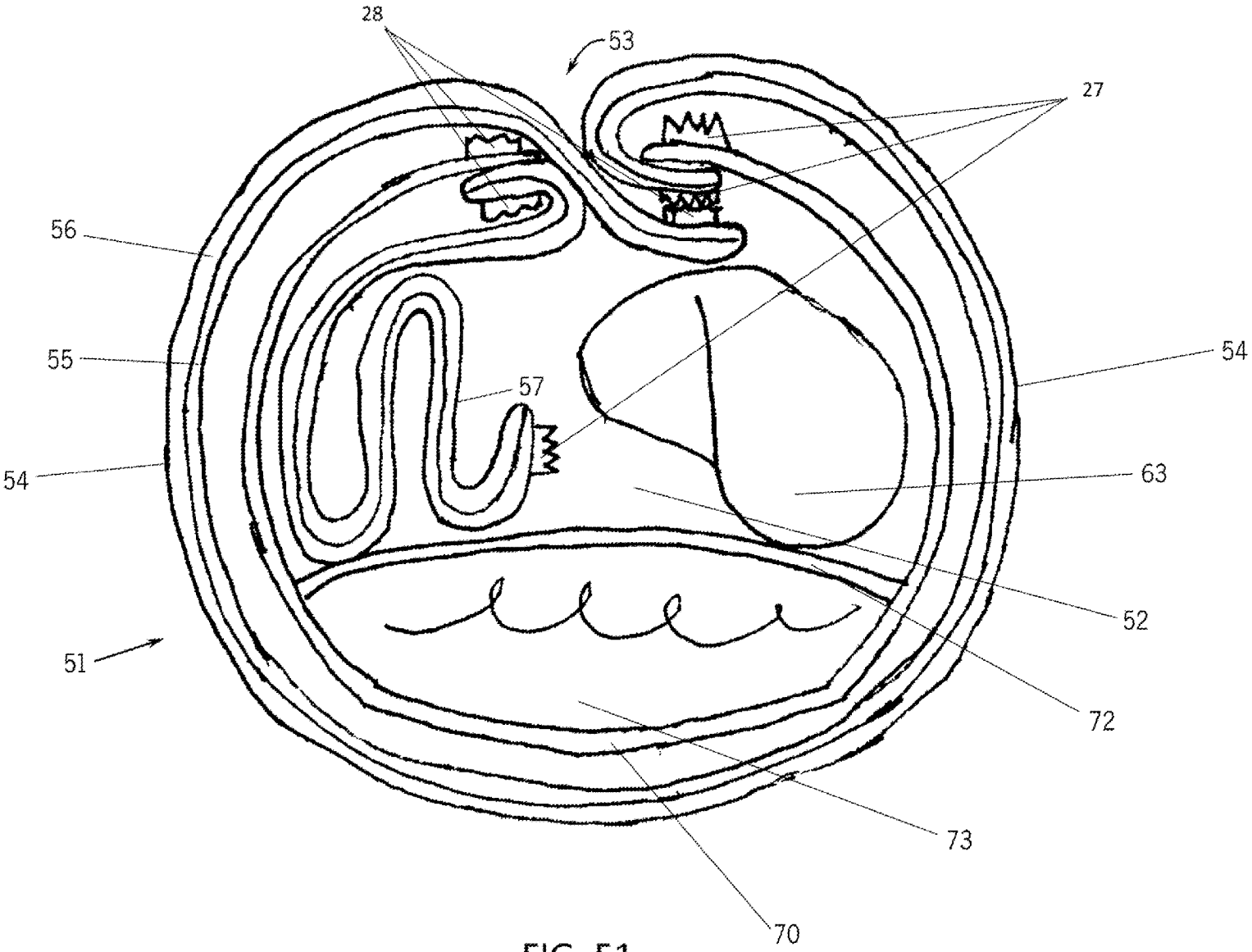

FIG. 51 is another schematic cross-sectional view of the doll figure portion 51 viewed from the bottom of the doll figure portion 51 with the slotted opening 53 of the interior storage pocket 52 oriented toward the top of the drawing sheet, and showing the doll toy 50 dressed in the second costume 56. In this configuration the first reversible garment 54 can be passed out from the opening 53 of the interior storage pocket 52 and wrapped clockwise around the doll figure portion 51, and then secured with the hook and loop-type closure utilizing the "loop" portion 28 on the interior surfaces of the pocket adjacent the edge or lip of the opening 53 to which the reversible garment is attached and the "hook" configuration 27 on the side of the second costume 56 of the reversible garment 54, as shown in FIG. 39. Again, the second reversible garment 57 and second reversible hat 63 are shown within the interior storage pocket 17 in the doll figure portion 51.

The third and fourth costumes of the second reversible garment can be similarly manipulated to utilize the various costumes.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended thereto.

What is claimed is:

1. A doll toy, the doll toy comprising:

a body defining an exterior surface;

an internal cavity formed in the body and in communication with the exterior surface through at least one opening; and a pair of separate interchangeable costumes, each of the pair of separate interchangeable costumes including at least one first edge portion and at least one second panel portion, with each of the first edge portions being secured within the internal cavity and each of the second panel portions configured to extend outward through the at least one opening to cover at least a portion of the body of the doll toy, wherein the internal cavity is operable to receive and entirely enclose one of the separate interchangeable costumes while the at least one second panel portion of the other of the separate interchangeable costumes is operable to extend from the at least one opening to cover at least a portion of the body of the doll toy.

2. The doll toy of claim 1, wherein the at least one opening further comprises a first opening spaced from a second opening and the pair of separate interchangeable costumes further comprises:

a first costume having two first edge portions secured within the internal cavity and two second panel portions extendable through the first opening and second openings, respectively; and a second costume having two first edge portions secured within the internal cavity and two second panel portions extendable through the first opening and second openings, respectively, wherein the second panel portions of the first costume covering the at least a portion of the body of the doll toy are interchangeable with the second panel portions of the second costume.

3. The doll toy of claim 2, further comprising a hat operable to removably couple to the doll toy, the hat having a first configuration and operable to reverse to a second configuration, wherein the first configuration corresponds to the first costume and the second configuration corresponds to the second costume.

4. The doll toy of claim 2, wherein at least one of the pair of separate interchangeable costumes is a reversible costume having a third costume defined on an opposite side of the second panel portion, wherein one of the first and second costumes is visible when the second panel portion is wrapped around the at least a portion of the body of the doll toy in a first direction, and wherein the third costume is visible when the second panel portion is wrapped about around the at least a portion of the body of the doll toy in a direction opposite the first direction.

5. The doll toy of claim 1, wherein the body of the doll toy further comprises a primary figure and a secondary container defining the internal cavity and a pair of openings, wherein the secondary container is operable to removably couple to the primary figure, and wherein each of the second panel portions is configured to extend outward through one of the pair of openings of the secondary container to cover at least a portion of the primary figure of the body of the doll toy.

6. The doll toy of claim 5, wherein each of the pair of separate interchangeable costumes further comprises an opposing pair of first edge portions combined with opposing second panel portions.

7. The doll toy of claim 6, wherein the secondary container is removably coupled to the primary figure with the opposing pair of second panel portions.

8. The doll toy of claim 7, wherein outer edges of the opposing pair of second panel portions are configured for coupling together around the primary figure with a fabric fastener to removably couple the secondary container to the primary figure.

9. The doll toy of claim 5, wherein the primary figure is a turtle and the secondary container is a turtle shell.

10. The doll toy of claim 1, wherein the body of the doll toy further comprises a primary figure defining the internal cavity and the at least one opening further comprises a single opening.

11. The doll toy of claim 10, wherein the primary figure is selected from a group consisting of a rabbit, a mouse, a cow, a bear, an elephant, and a human, and wherein the single opening extends along a back of the primary figure.

12. A doll toy, the doll toy comprising:

a body defining an exterior surface;

an internal cavity formed in the body and in communication with the exterior surface through at least one opening; and a first costume and a separate second costume interchangeable with the first costume, each of the first costume and the second costume including an edge portion and a panel portion, with each of the edge portions being secured within the internal cavity and each of the panel portions configured to extend outward through the at least one opening to cover at least a portion of the body of the doll toy, wherein the internal cavity is operable to receive and entirely enclose the edge portion and the panel portion of the one of the first and second costumes while the panel portion of the other of the first and second costumes is operable to extend from the at least one opening to cover at least a portion of the body of the doll toy.

13. The doll toy of claim 12 and further comprising a third costume separate from the first costume and the second costume and interchangeable with the first costume and the second costume, the third costume also including an edge portion secured within the internal cavity and a panel portion configured to extend outward through the at least one opening to cover at least a portion of the body of the doll toy, wherein the internal cavity is operable to receive and entirely enclose the edge portions and the panel portions of two of the first, second and third costumes while the panel portion of one of the first, second and third costumes is operable to extend from the at least one opening to cover at least a portion of the body of the doll toy.

14. The doll toy of claim 12, wherein each of the first costume and the separate second costume further comprises an opposing pair of edge portions combined with an opposing pair of panel portions, and wherein the at least one opening further comprises a first opening and a second opening spaced from the first opening.

15. The doll toy of claim 14, wherein the body of the doll toy further comprises a primary figure and a secondary container defining the internal cavity with the first and second openings, and wherein each of the opposing pair of panel portions is configured to extend outward through the first opening or the second opening of the secondary container to cover at least a portion of the primary figure of the body of the doll toy.

16. The doll toy of claim 15, wherein outer edges of each of the opposing pair of panel portions are configured for coupling together around the primary figure to removably couple the secondary container to the primary figure.

17. The doll toy of claim 12, wherein the body of the doll toy further comprises a primary figure defining the internal cavity and the at least one opening.

18. The doll toy of claim 17, wherein the at least one opening extends along a back of the primary figure.

19. The doll toy of claim 12, wherein at least one of the first costume and the second costume is a reversible costume having a third costume defined on an opposite side of the panel portion, wherein one of the of the first costume and the separate second costume is visible when the panel portion is wrapped around the at least a portion of the body of the doll toy in a first direction, and wherein the third costume is visible when the panel portion is wrapped about around the at least a portion of the body of the doll toy in a direction opposite the first direction.

* * * * *